US008312732B2

(12) United States Patent
Sakitani et al.

(10) Patent No.: US 8,312,732 B2
(45) Date of Patent: Nov. 20, 2012

(54) REFRIGERATING APPARATUS

(75) Inventors: Katsumi Sakitani, Osaka (JP); Masakazu Okamoto, Osaka (JP); Eiji Kumakura, Osaka (JP); Tetsuya Okamoto, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1077 days.

(21) Appl. No.: 12/226,135

(22) PCT Filed: Apr. 16, 2007

(86) PCT No.: PCT/JP2007/058287

§ 371 (c)(1),
(2), (4) Date: Oct. 9, 2008

(87) PCT Pub. No.: WO2007/123087

PCT Pub. Date: Nov. 1, 2007

(65) Prior Publication Data

US 2009/0277213 A1 Nov. 12, 2009

(30) Foreign Application Priority Data

Apr. 20, 2006 (JP) ..... 2006-116686

(51) Int. Cl.
*F04B 39/02* (2006.01)

(52) U.S. Cl. ..... 62/193; 62/468; 62/510; 418/84

(58) Field of Classification Search ..... 62/84, 192, 62/193, 468; 184/6.16
See application file for complete search history.

(56) References Cited

U.S. PATENT DOCUMENTS

| | | | | |
|---|---|---|---|---|
| 3,785,169 | A * | 1/1974 | Gylland, Jr. | 62/468 |
| 4,411,141 | A * | 10/1983 | Hara | 62/468 |
| 7,918,096 | B2 * | 4/2011 | Sakitani et al. | 62/192 |
| 8,109,116 | B2 * | 2/2012 | Sekiya et al. | 62/468 |
| 8,122,735 | B2 * | 2/2012 | Sakitani et al. | 62/468 |
| 2007/0214827 | A1 * | 9/2007 | Venkatasubramaniam | 62/468 |

FOREIGN PATENT DOCUMENTS

| | | | |
|---|---|---|---|
| JP | 2000-241033 | A | 9/2000 |
| JP | 2001-141315 | A | 5/2001 |
| JP | 2003-240366 | A | 8/2003 |
| JP | 2004325019 | A * | 11/2004 |
| JP | 2005-2832 | A | 1/2005 |
| JP | 2005-299632 | A | 10/2005 |
| JP | 2007-24439 | A | 2/2007 |
| JP | 2007-113815 | A | 5/2007 |
| JP | 2008002777 | A * | 1/2008 |
| JP | 2008106986 | A * | 5/2008 |
| JP | 2008107049 | A * | 5/2008 |
| JP | 2008209044 | A * | 9/2008 |
| JP | 2008286151 | A * | 11/2008 |
| JP | 2009068733 | A * | 4/2009 |

* cited by examiner

*Primary Examiner* — Allen Flanigan
(74) *Attorney, Agent, or Firm* — Birch, Stewart, Kolasch, Birch, LLP

(57) ABSTRACT

A compressor and an expander are provided in a refrigerant circuit of an air conditioner. In the compressor, refrigerator oil is supplied from an oil reservoir to a compression mechanism. In the expander, the refrigerator oil is supplied from an oil reservoir to an expansion mechanism. Internal spaces of a compressor casing and an expander casing communicate with each other through an equalizing pipe. An oil pipe connecting the compressor casing and the expander casing is provided with an oil amount adjusting valve operated on the basis of an output signal of an oil level sensor. When the oil amount adjusting valve is opened, the oil reservoir in the compressor casing and the oil reservoir in the expander casing communicate with each other to allow the refrigerator oil to flow through the oil pipe.

15 Claims, 21 Drawing Sheets

REFRIGERATING APPARATUS

TECHNICAL FIELD

The present invention relates to lubricant oil supply to a compressor and an expander in a refrigerating apparatus.

BACKGROUND ART

Conventionally, refrigerating apparatuses performing a refrigeration cycle by circulating refrigerant in a refrigerant circuit have been known and are widely used in air conditioners and the like. For example, Patent Document 1 discloses a refrigerating apparatus including a compressor for compressing refrigerant and an expander for expanding the refrigerant to recover motive power. Specifically, in a refrigerating apparatus shown in FIG. 1 in Patent Document 1, the expander is connected to the compressor through a single shaft so that the motive power obtained in the expander is utilized for driving the compressor. In another refrigerating apparatus shown in FIG. 6 in Patent Document 1, a motor and a generator are connected to the compressor and the expander, respectively, so that the compressor is driven by the motor to compress the refrigerant while the generator is driven by the expander to generate motive power.

A fluid machinery in which an expander and a compressor are connected to each other through a single shaft is disclosed in Patent Document 2, for example. In the fluid machinery disclosed in this patent document, a compression mechanism as a compressor, an expansion mechanism as an expander, and a shaft connecting them are housed in a single casing. Further, in this fluid machinery, an oil supply path is formed inside the shaft to supply lubricant oil reserved in the bottom of the casing to the compression mechanism and the expansion mechanism through the oil supply path.

Patent Document 3 discloses a generally-called hermetic compressor in which a compression mechanism and a motor are housed in a single casing. In the hermetic compressor, an oil supply path is formed in a drive shaft of a compression mechanism so that lubricant oil reserved in the bottom of the casing is supplied to the compression mechanism through the oil supply path. The refrigerating apparatus shown in FIG. 6 in Patent Document 1 may use a hermetic compressor of this kind.

Patent Document 1: Japanese Unexamined Patent Application Publication No. 2000-241033

Patent Document 2: Japanese Unexamined Patent Application Publication No. 2005-299632

Patent Document 3: Japanese Unexamined Patent Application Publication No. 2005-002832

SUMMARY OF THE INVENTION

Problems that the Invention is to Solve

As described above, a generally-known compressor provided in a refrigerant circuit has a construction in which a compression mechanism is housed in a casing so that lubricant oil reserved in the casing is supplied to the compression mechanism. As to an expander, it may have a similar construction in which an expansion mechanism is housed in a casing so that lubricant oil reserved in the casing is supplied to the expansion mechanism.

In the refrigerating apparatus shown in FIG. 6 in Patent Document 1, the compressor and the expander each including a separate casing may be provided in the refrigerant circuit so that the compression mechanism is lubricated by the lubricant oil in the casing of the compressor while the expansion mechanism is lubricated by the lubricant oil in the casing of the expander. In the refrigerating apparatus in this construction, however, the lubricant oil may be distributed unevenly to one of the compressor and the expander to cause a trouble, such as seizing and the like.

This problem will be described. During the operation of the compressor, part of the lubricant oil supplied to the compression mechanism is discharged from the compressor together with the refrigerant. As well, during the operation of the expander, part of the lubricant oil supplied to the expansion mechanism flows out from the expander together with the refrigerant. Namely, in the refrigerant circuit of the refrigerating apparatus including both the compressor and the expander, the lubricant oil flowing out from the casing of the compressor and the lubricant oil flowing out from the casing of the expander are circulated together with the refrigerant. If the lubricant oil of which amount corresponds to the amount thereof flowing out from the compressor can be returned to the casing of the compressor while the lubricant oil of which amount corresponds to the amount thereof flowing out from the expander can be returned to the casing of the expander, a given amount of the lubricant oil is secured in each of the casings of the compressor and the expander.

It is rather difficult, however, to set accurately the ratio between the amount of the lubricant oil returned to the compressor and that returned to the expander in the total amount of the lubricant oil circulating in the refrigerant circuit. In other words, it is practically impossible to return to the compressor the lubricant oil of which amount corresponds to the amount thereof flowing out from the compressor and to return to the expander the lubricant oil of which amount corresponds to the amount thereof flowing out from the expander. For this reason, the lubricant oil is unevenly distributed to one of the compressor and the expander in the operation of the refrigerating apparatus, and consequently, a trouble, such as seizing and the like may be caused in one of them in which the amount of the lubricant oil in the casing is less.

The present invention has been made in view of the foregoing and has its object of ensuring the reliability of a refrigerating apparatus including a refrigerant circuit in which a compressor and an expander are housed in separate casings.

Means for Solving the Problems

A first aspect of the present invention is directed to a refrigerating apparatus including a refrigerant circuit (11) to which a compressor (20) and an expander (30) are connected and performing a refrigeration cycle by circulating refrigerant in the refrigerant circuit (11). Wherein, the refrigerating apparatus includes: in the compressor (20), a compression mechanism (21) for sucking and compressing the refrigerant; a compressor casing (24) for housing the compression mechanism (21); and an oil supply mechanism (22) for supplying lubricant oil from an oil reservoir (27) in the compressor casing (24) to the compression mechanism (21); in the expander (30), an expansion mechanism (31) for expanding the refrigerant flowing therein to generate motive power; an expander casing (34) for housing the expansion mechanism (31); and an oil supply mechanism (32) for supplying the lubricant oil from an oil reservoir (37) in the expander (34) to the expansion mechanism (31); an equalizing path (40) which connects the compressor casing (24) and the expander casing (34) for equalizing pressures of an internal space of the compressor casing (34) and an internal space of the expander casing (34) to each other; and an oil distribution path (42) which connects the compressor casing (34) and the expander casing (34) for allowing the lubricant oil to flow between the oil reservoir (27) in the compressor casing (24) and the oil reservoir (37) in the expander casing (34).

In the first aspect, the refrigerant is circulated while repeating the processes of compression, condensation, expansion, and evaporation sequentially in the refrigerant circuit (11). During the operation of the compressor (20), the oil supply mechanism (22) supplies the lubricant oil from the oil reservoir (27) in the compressor casing (24) to the compression mechanism (21), and part of the lubricant oil supplied to the compression mechanism (21) is discharged from the compressor (20) together with the refrigerant compressed in the compression mechanism (21). During the operation of the expander (30), the oil supply mechanism (32) supplies the lubricant oil from the oil reservoir (37) in the expander casing (34) to the expansion mechanism (31), and part of the lubricant oil supplied to the expansion mechanism (31) is sent out from the expander (20) together with the refrigerant expanded in the expansion mechanism (31). Each lubricant oil flowing out from the compressor (20) and the expander (30) is circulated in the refrigerant circuit (11) together with the refrigerant and is returned to the compressor (30) and the expander (30).

In the first aspect, the oil reservoir (27) in the compressor casing (24) and the oil reservoir (37) in the expander casing (34) communicate with each other through the oil distribution path (42). Further, the compressor casing (24) and the expander casing (34) are connected to each other through the equalizing path (40) so that the inner pressure of the compressor casing (24) and that of the expander casing (34) are almost equal to each other even in the operation of both the compressor (20) and the expander (30). Accordingly, even when the lubricant oil is unevenly distributed to, for example, the compressor (20), which results in that the reserved amount of the lubricant oil in the compressor casing (24) is excessive, the surplus lubricant oil in the compressor casing (24) flows into the expander casing (34) through the oil distribution path (42).

Referring to a second aspect of the present invention, in the first aspect, there is provided adjusting means (50) for adjusting a flow state of the lubricant oil in the oil distribution path (42).

In the second aspect, the adjusting means (50) adjusts the flowing state of the lubricant oil flowing in the oil distribution path (42). In other words, the flowing state of the lubricant oil moving between the compressor casing (24) and the expander casing (34) through the oil distribution path (42) is adjusted by the adjusting means (50).

Referring to a third aspect of the present invention, in the second aspect, the adjusting means (50) includes an oil level detector (51) for detecting an oil level in the oil reservoir (27) in the compressor casing (24) or in the oil reservoir (37) in the expander casing (34) and a control valve (52) which is provided in the oil distribution path (42) and of which opening is controlled on the basis of an output signal of the oil level detector (51).

In the third aspect, the adjusting means (50) includes the oil level detector (51) and the control valve (52). The reserved amount of the lubricant oil in the compressor casing (24) correlates to the oil level in the oil reservoir (27) in the compressor casing (24). As well, the reserved amount of the lubricant oil in the expander casing (34) correlates to the oil level in the oil reservoir (37) in the expander casing (34). When information on the oil level of one of the oil reservoirs (27) in the compressor casing (24) and the oil reservoir (37) in the expander casing (34) is acquired, whether the lubricant oil is excessive or deficient in the compressor (20) and the expander (30) can be judged on the basis of the information. In view of this, in this aspect, the oil level of the lubricant oil in one of the oil reservoir (27) in the compressor casing (24) and the oil reservoir (37) in the expander casing (34) is detected by the oil level detector (51) to control the opening of the control valve (52) according to the output signal of the oil level detector (51), thereby controlling the flow rate of the lubricant oil in the oil distribution path (42).

Referring to a fourth aspect of the present invention, in the first aspect, the refrigerant circuit (11) includes an oil separator (60) arranged on a discharge side of the compressor (20) for separating the lubricant oil from the refrigerant and an oil return path (61) for supplying the lubricant oil from the oil separator (60) to the compressor casing (24).

In the fourth aspect, the lubricant oil flowing in the refrigerant circuit (11) together with the refrigerant is separated from the refrigerant by the oil separator (60) arranged downstream of the compressor (20). The lubricant oil separated from the refrigerant in the oil separator (60) is sent into the compressor casing (24) through the oil return path (61). Part of the lubricant oil in the compressor casing (24) is supplied into the expander casing (34) through the oil distribution path (42). Namely, each lubricant oil flowing out from the expander (30) and the compressor (20) in the refrigerant circuit (11) is once returned into the compressor casing (24) and is then distributed to the expander (30) from the oil reservoir (27) in the compressor casing (24).

Referring to a fifth aspect of the present invention, in the first aspect, the refrigerant circuit (11) includes an oil separator (60) arranged on a discharge side of the compressor (20) for separating the lubricant oil from the refrigerant and an oil return path (62) for supplying the lubricant oil from the oil separator (60) to the expander casing (34). In the fifth aspect, the lubricant oil flowing in the refrigerant circuit (11) together with the refrigerant is separated from the refrigerant by the oil separator (60) arranged downstream of the compressor (20). The lubricant oil separated from the refrigerant in the oil separator (60) is sent into the expander casing (34) through the oil return path (62). Part of the lubricant oil in the expander casing (34) is supplied into the compressor casing (24) through the oil distribution path (42). Namely, each lubricant oil flowing out from the expander (30) and the compressor (20) in the refrigerant circuit (11) is once returned into the expander casing (34) and is then distributed to the compressor (20) from the oil reservoir (37) in the expander casing (34).

Referring to a sixth aspect of the present invention, in the first aspect, the refrigerant circuit (11) includes an oil separator (70) arranged on an outflow side of the expander (30) for separating the lubricant oil from the refrigerant and an oil return path (71) for supplying the lubricant oil from the oil separator (70) to the compressor casing (24).

In the sixth aspect, the lubricant oil flowing in the refrigerant circuit (11) together with the refrigerant is separated from the refrigerant by the oil separator (70) arranged downstream of the expander (30). The lubricant oil separated from the refrigerant in the oil separator (70) is sent into the compressor casing (24) through the oil return path (71). Part of the lubricant oil in the compressor casing (24) is supplied into the expander casing (34) through the oil distribution path (42). Namely, each lubricant oil flowing out from the expander (30) and the compressor (20) in the refrigerant circuit (11) is once returned into the compressor casing (24) and is then distributed to the expander (30) from the oil reservoir (27) in the compressor casing (24).

Referring to a seventh aspect of the present invention, in the first aspect, the compression mechanism (21) compresses the refrigerant directly sucked from outside of the compressor casing (24) and discharge it into the compressor casing (24).

In the seventh aspect, the compression mechanism (21) sucks the refrigerant flowing into the compressor (20) directly. The compression mechanism (21) compresses the thus sucked refrigerant and discharges it into the compressor casing (24). Namely, the refrigerant compressed in the compression mechanism (21) is once discharged into the internal space of the compressor casing (24) and is then sent outside the compressor casing (24). The inner pressure of the compressor casing (24) is almost equal to the pressure of the refrigerant discharged from the compression mechanism (21). Further, since the expander casing (34) is connected to the compressor casing (24) through the equalizing path (40), the inner pressure of the expander casing (34) is almost equal to the pressure of the refrigerant discharged from the compression mechanism (21).

Referring to an eighth aspect of the present invention, in the seventh aspect, the refrigerant circuit (11) includes an oil separator (60) arranged on a discharge side of the compressor (20) for separating the lubricant oil from the refrigerant and an oil return path (62) for supplying the lubricant oil from the oil separator (60) to the expander casing (34), and a pipe connecting the compressor (20) and the oil separator (60) and the oil return path (62) serve as the equalizing path (40).

In the eighth aspect, the lubricant oil flowing in the refrigerant circuit (11) together with the refrigerant is separated from the refrigerant by the oil separator (60) arranged downstream of the compressor (20). The lubricant oil separated from the refrigerant in the oil separator (60) is supplied into the expander casing (34) through the oil return path (62). Part of the lubricant oil in the expander casing (34) is supplied into the compressor casing (24) through the oil distribution path (42). Namely, each lubricant oil flowing out from the expander (30) and the compressor (20) in the refrigerant circuit (11) is once returned into the expander casing (34) and is then distributed to the compressor (20) from the oil reservoir (37) in the expander casing (34).

In the eighth aspect, the internal space of the compressor casing (24) communicates with the oil separator (60) through the pipe while the oil separator (60) communicates with the internal space of the expander casing (34) through the oil return path (71). Namely, the internal space of the compressor casing (24) and the internal space of the expander casing (34) communicate with each other through the pipe connecting the compressor (20) and the oil separator (60) and the oil return path (71). Accordingly, in this aspect, the oil return path (71) and the pipe connecting the compressor (20) and the oil separator (60) serve as the equalizing path (40).

Referring to a ninth aspect of the present invention, in the first aspect, the compression mechanism (21) compresses the refrigerant sucked from the compressor casing (24) and discharges it outside the compressor casing (24) directly.

In the ninth aspect, the refrigerant flowing in the compressor (20) once flows into the internal space of the compressor casing (24) and is then sucked into the compression mechanism (21). The compression mechanism (21) compresses the thus sucked refrigerant and discharges it directly outside the compressor casing (24). The inner pressure of the compressor casing (24) is almost equal to the pressure of the refrigerant that the compression mechanism (21) sucks. The expander casing (34) is connected to the compressor casing (24) through the equalizing path (40), so that the inner pressure of the expander casing (34) is almost equal to the pressure of the refrigerant that the compression mechanism (31) sucks.

Referring to a tenth aspect of the present invention, in the ninth aspect, the refrigerant circuit (11) includes an oil separator (75) arranged on a suction side of the compressor (20) for separating the lubricant oil from the refrigerant and an oil return path (76) for supplying the lubricant oil from the oil separator (75) to the compressor casing (24).

In the tenth aspect, the lubricant oil flowing in the refrigerant circuit (11) together with the refrigerant is separated from the refrigerant by the oil separator (75) arranged upstream of the compressor (20). The lubricant oil separated from the refrigerant in the oil separator (75) is sent into the compressor casing (24) through the oil return path (76). Part of the lubricant oil in the compressor casing (24) is supplied into the expander casing (34) through the oil distribution path (42). Namely, each lubricant oil flowing out from the expander (30) and the compressor (20) in the refrigerant circuit (11) is once returned into the compressor casing (24) and is then distributed to the expander (30) from the oil reservoir (27) in the compressor casing (24).

Referring to an eleventh aspect of the present invention, in the ninth aspect, the refrigerant circuit (11) includes an oil separator (75) arranged on a suction side of the compressor (20) for separating the lubricant oil from the refrigerant and an oil return path (77) for supplying the lubricant oil from the oil separator (75) to the expander casing (34).

In the eleventh aspect, the lubricant oil flowing in the refrigerant circuit (11) together with the refrigerant is separated from the refrigerant by the oil separator (75) arranged upstream of the compressor (20). The lubricant oil separated from the refrigerant in the oil separator (75) is sent into the expander casing (34) through the oil return path (77). Part of the lubricant oil in the expander casing (34) is supplied into the compressor casing (24) through the oil distribution path (42). Namely, each lubricant oil flowing out from the expander (30) and the compressor (20) in the refrigerant circuit (11) is once returned into the expander casing (34) and is then distributed to the compressor (20) from the oil reservoir (37) in the expander casing (34).

Referring to a twelfth aspect of the present invention, in the eleventh aspect, a pipe connecting the oil separator (75) and the compressor (20) and the oil return path (77) serve as the equalizing path (40).

In the twelfth aspect, the internal space of the compressor casing (24) communicates with the oil separator (75) through the pipe while the internal space of the expander casing (34) communicates with the oil separator (75) through the oil return path (77). Namely, the internal space of the compressor casing (24) and the internal space of the expander casing (34) communicate with each other through the pipe connecting the oil separator (75) and the compressor (20) and the oil return path (77). In this aspect, the oil return path (77) and the pipe connecting the oil separator (75) and the compressor (20) serve as the equalizing path (40).

Referring to a thirteenth aspect of the present invention, in the ninth aspect, the refrigerant circuit (11) includes an oil separator (70) arranged on an outflow side of the expander (30) for separating the lubricant oil from the refrigerant and an oil return path (72) for supplying the lubricant oil from the oil separator (70) to the expander casing (34).

In the thirteenth aspect, the lubricant oil flowing in the refrigerant circuit (11) together with the refrigerant is separated from the refrigerant by the oil separator (70) arranged downstream of the expander (30). The lubricant oil separated from the refrigerant in the oil separator (70) is sent into the expander casing (34) through the oil return path (72). Part of the lubricant oil in the expander casing (34) is supplied into the compressor casing (24) through the oil distribution path (42). Namely, each lubricant oil flowing out from the expander (30) and the compressor (20) in the refrigerant circuit (11) is once returned into the expander casing (34) and is then distributed to the compressor (20) from the oil reservoir (37) in the expander casing (34).

Effects of the Invention

In the present invention, the compressor casing (24) and the expander casing (34) are connected to each other through the equalizing path (40) and the oil distribution path (42). Accordingly, even when the lubricant oil is unevenly distributed to one of the compressor (20) and the expander (30) in the operation of the refrigerating apparatus (10), the lubricant oil in one of the compressor (20) and the expander (30) to which the lubricant oil is distributed excessively can be supplied to the other through the oil distribution path (42). As a result, each reserved amount of the lubricant oil in the compressor casing (24) and the expander casing (34) can be secured to achieve definite lubrication of the compression mechanism (21) and the expansion mechanism (31). Hence, according to the present invention, damage of the compressor (20) and the expander (30) caused due to insufficient lubrication can be prevented to ensure the reliability of the refrigerating apparatus (10).

In the second and third aspects of the present invention, the adjusting means (50) adjusts the flowing state of the lubricant oil moving between the compressor casing (24) and the expander casing (34) through the oil distribution path (42). Accordingly, each reserved amount of the lubricant oil in the compressor casing (24) and the expander casing (34) can be controlled further accurately to further increase the reliability of the refrigerating apparatus (10).

In the fourth, fifth, and eighth aspects of the present invention, the lubricant oil is collected in the oil separator (60) arranged downstream of the compressor (20). Accordingly, the amount of the lubricant can be reduced which flows in a part of the refrigerant circuit (11) which ranges from the oil separator (60) to the inflow side of the expander (30). A heat exchanger for heat radiation is provided at the part of the refrigerant circuit (11) which ranges from the oil separator (60) to the expander (30). Hence, in these aspects, the situation that the lubricant oil inhibits heat radiation of the refrigerant in the heat exchanger for heat radiation can be suppressed, thereby allowing the heat exchanger to exert its performance fully.

Particularly, in the eighth aspect of the present invention, the pipe connecting the compressor (20) and the oil separator (60) and the oil return path (71) serve as the equalizing path (40) to eliminate the need to prepare a dedicated member for forming the equalizing path (40), thereby keeping the simple construction of the refrigerating apparatus (10).

In the sixth and thirteenth aspects of the present invention, the lubricant oil is collected in the oil separator (70) arranged downstream of the expander (30). Accordingly, the amount of the lubricant oil can be reduced which flows in a part of the refrigerant circuit (11) which ranges from the oil separator (70) to the suction side of the compressor (20). A heat exchanger for heat absorption is provided at the part of the refrigerant circuit (11) which ranges from the oil separator (70) to the compressor (20). Hence, in these aspects, the situation that the lubricant oil inhibits absorption of the heat of the refrigerant in the heat exchanger for heat absorption can be suppressed, thereby allowing the heat exchanger to exert its performance fully.

In the ninth aspect of the present invention, the expander casing (34) communicates through the equalizing path (40) with the compressor casing (24) filled with the refrigerant before being sucked into the compression mechanism (21). Herein, since a heat exchanger for heat absorption is provided downstream of the expander (30) in the refrigerant circuit (11), it is desirable for securing the absorption amount of the heat of the refrigerant in the heat exchanger to set the enthalpy of the refrigerant flowing out from the expander (30) low as far as possible. On the other hand, the temperature of the refrigerant before being sucked into the compression mechanism (21) is not so high. In this aspect, the expander casing (34) communicates with the compressor casing (24) filled with the refrigerant before being sucked into the compression mechanism (21), so that the temperature in the expander casing (34) becomes not so high. This suppresses the amount of heat that invades the refrigerant expanded in the expansion mechanism (31) to suppress the enthalpy of the refrigerant flowing out from the expander (30) low. Hence, in the present aspect, the absorption amount of the heat of the refrigerant in the heat exchanger for heat absorption can be secured sufficiently.

In the tenth and eleventh aspects of the present invention, the lubricant oil is collected in the oil separator (75) arranged upstream of the compressor (20). Accordingly, the amount of the lubricant oil can be reduced which is sucked into the compression mechanism (21) together with the refrigerant. Since the volume of the fluid that the compression mechanism (21) can suck in a single suction stroke is determined, decrease in amount of the lubricant oil to be sucked into the compression mechanism (21) together with the refrigerant increases the amount of the refrigerant to be sucked into the compression mechanism (21). Hence, in the present aspect, the compressor (21) can exert its performance fully.

In the twelfth aspect of the present invention, the pipe connecting the oil separator (75) and the compressor (20) and the oil return path (77) serve as the equalizing path (40) to eliminate the need to prepare a dedicated member for forming the equalizing path (40), thereby keeping the simple construction of the refrigerating apparatus (10).

INDEX OF REFERENCE NUMERALS

Figure 1:
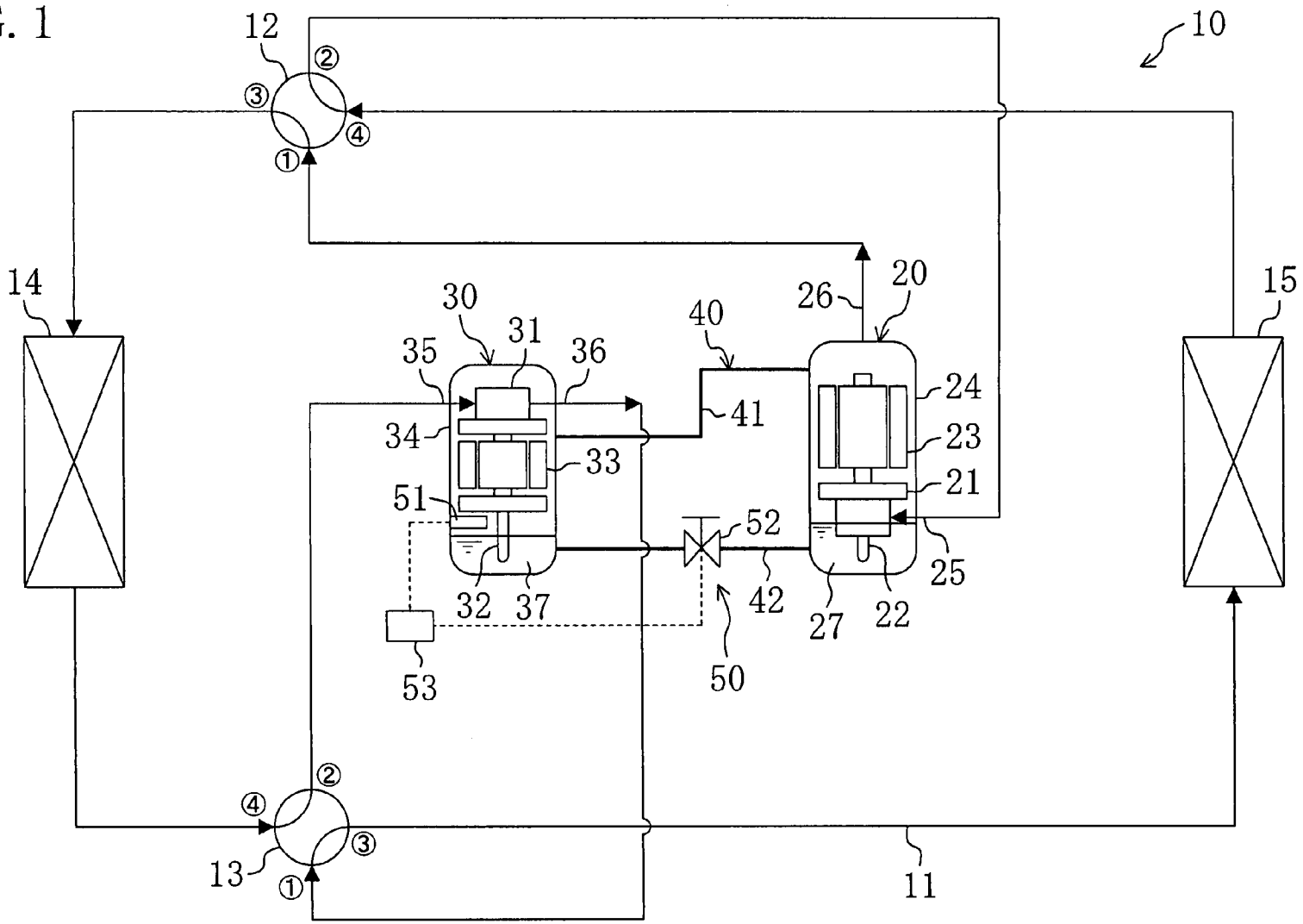
FIG. 1 is a refrigerant circuit diagram showing a construction of a refrigerant circuit and the flow of refrigerant in a cooling operation in accordance with Embodiment 1.

10 air conditioner (refrigerating apparatus)
11 refrigerant circuit
20 compressor
21 compression mechanism
22 drive shaft (oil supply mechanism)
24 compressor casing
27 oil reservoir
30 expander
31 expansion mechanism
32 output shaft (oil supply mechanism)
34 expander casing
37 oil reservoir
40 equalizing path
42 oil pipe (oil distribution path)
50 adjusting means
51 oil level sensor (oil level detector)
52 oil amount adjusting valve (control valve)
60 oil separator
61 oil return pipe (oil return path)
62 oil return pipe (oil return path)
70 oil separator
71 oil return pipe (oil return path)
72 oil return pipe (oil return path)
75 oil separator
76 oil return pipe (oil return path)
77 oil return pipe (oil return path)

BEST MODE FOR CARRYING OUT THE INVENTION

Embodiments of the present invention will be described below in detail with reference to the accompanying drawings.

<Embodiment 1 of the Invention>

Embodiment 1 of the present invention will be described. The present embodiment is directed to an air conditioner (10) composed of a refrigerating apparatus in accordance with the present invention.

Figure 2:
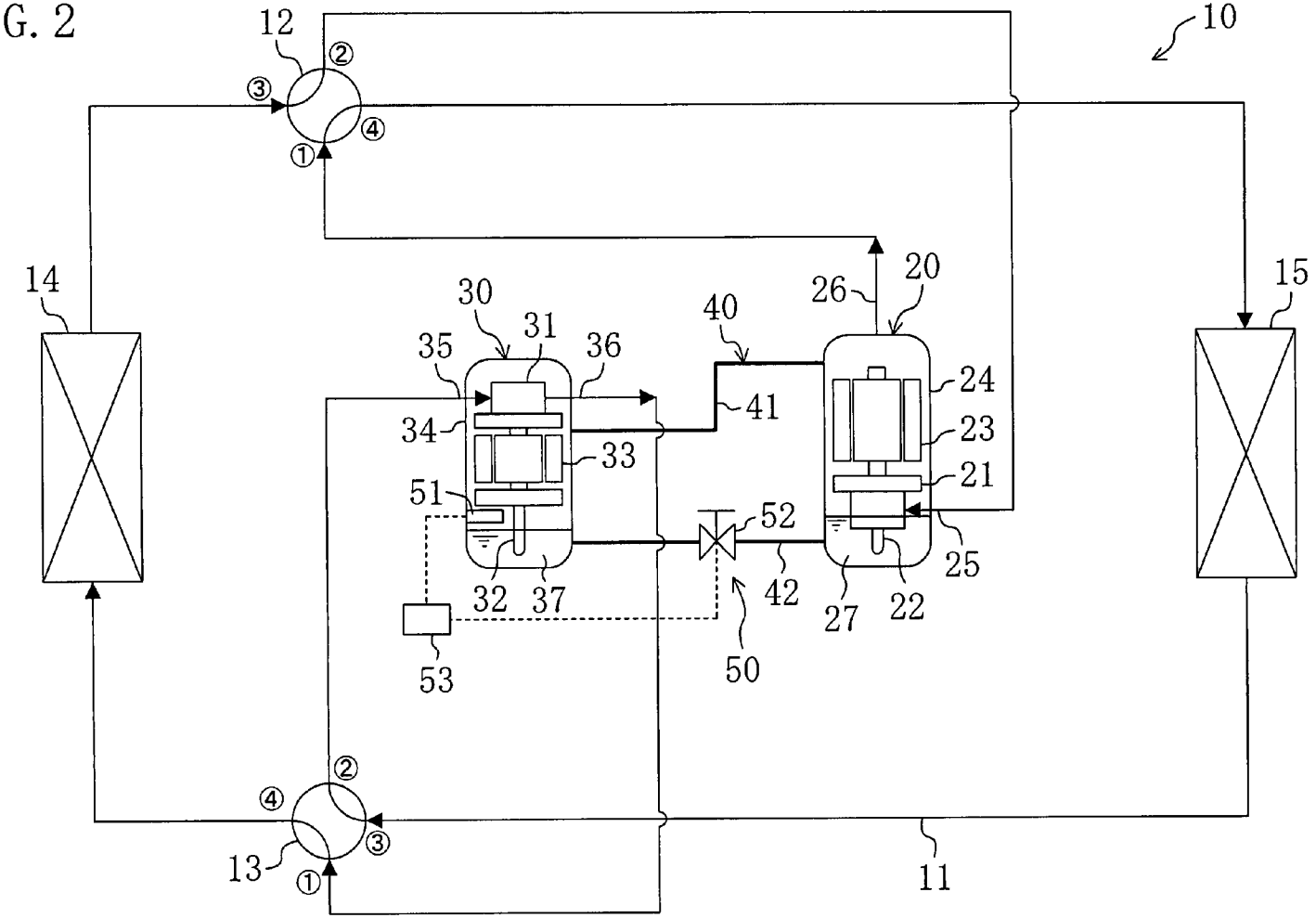
FIG. 2 is a refrigerant circuit diagram showing a construction of the refrigerant circuit and the flow of refrigerant in a heating operation in accordance with Embodiment 1.

As shown in FIG. 1 and FIG. 2, the air conditioner (10) of the present embodiment includes a refrigerant circuit (11). To the refrigerant circuit (11), there are connected a compressor (20), an expander (30), an outdoor heat exchanger (14), an indoor heat exchanger (15), a first four-wary switching valve (12), and a second four-way switching valve (13). Carbon dioxide ($CO_2$) is filled in the refrigerant circuit (11) as a refrigerant. The compressor (20) and the expander (30) are arranged at almost the same level.

A construction of the refrigerant circuit (11) will be described. The compressor (20) includes a discharge pipe (26) connected to the first port of the first four-way switching valve (12) and a suction pipe (25) connected to the second port of the first four-way switching valve (12). The expander (30) includes an outflow pipe (36) connected to the first port of the second four-way switching valve (13) and an inflow pipe (35) connected to the second port of the second four-way switching valve (13). The outdoor heat exchanger (14) is connected at one end thereof to the third port of the first four-way switching valve (12) while being connected at the other end thereof to the fourth port of the second four-way switching valve (13). The indoor heat exchanger (15) is connected at one end thereof to the third port of the second four-way switching valve (13) while being connected at the other end thereof to the fourth port of the first four-way switching valve (12).

The outdoor heat exchanger (14) is an air heat exchanger for heat exchange between the refrigerant and outdoor air. The indoor heat exchanger (15) is an air heat exchanger for heat exchange between the refrigerant and indoor air. Each of the first four-way switching valve (12) and the second four-way switching valve (13) is switched between the state shown in FIG. 1 in which the first port and the third port communicate with each other while the second port and the fourth port communicate with each other and the state shown in FIG. 2 in which the first port and the fourth port communicate with each other while the second port and the third port communicate with each other.

Figure 3:
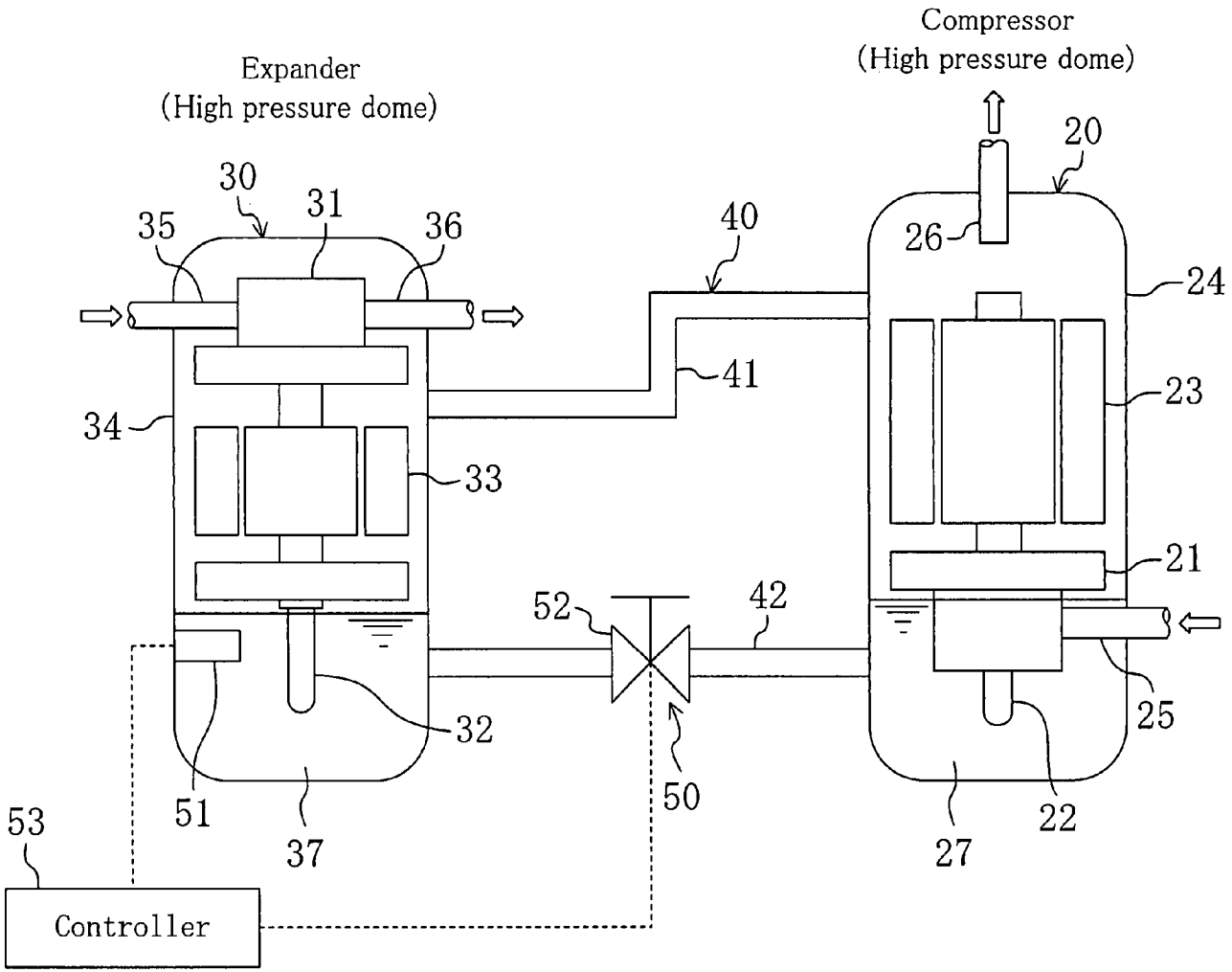
FIG. 3 is an enlarged view of a main part of the refrigerant circuit in accordance with Embodiment 1.

As also shown in FIG. 3, the compressor (20) is a generally-called hermetic compressor of high pressure dome type. The compressor (20) includes a vertically cylindrical compressor casing (24). Inside the compressor casing (24), there are housed a compression mechanism (21), a motor (23), and a drive shaft (22). The compression mechanism (21) is a generally-called rotary positive displacement fluid machinery. The motor (23) is arranged above the compression mechanism (21) in the compressor casing (24). The drive shaft (22) is arranged vertically to connect the compression mechanism (21) and the motor (23).

The suction pipe (25) and the discharge pipe (26) are provided at the compressor casing (24). The suction pipe (25) passes through the lower part of the compressor casing (24), and the terminal end thereof is connected directly to the compression mechanism (21). The discharge pipe (26) passes through the top of the compressor casing (24), and the start end thereof is opened to the space above the motor (23) in the compressor casing (24). The compression mechanism (21) compresses the refrigerant sucked from the suction pipe (25) and discharges it to the compressor casing (24).

In the bottom of the compressor casing (24), refrigerator oil is reserved as a lubricant oil. Namely, an oil reservoir (27) is formed within the compressor casing (24).

The drive shaft (22) composes an oil supply mechanism for supplying the refrigerator oil from the oil reservoir (27) to the compression mechanism (21). Though not shown, an axially extending oil supply path is formed inside the drive shaft (22). The oil supply path is opened at the lower end of the drive shaft (22) and serves as a generally-called centrifugal pump. The lower end of the drive shaft (22) is dipped in the oil reservoir (27). When the drive shaft (22) is rotated, the refrigerator oil is sucked by the operation of the centrifugal pump from the oil reservoir (27) into the oil supply path. The refrigerator oil sucked in the oil supply path is supplied to the compression mechanism (21) for lubrication of the compression mechanism (21).

The expander (30) includes a vertically cylindrical expander casing (34). Inside the expander casing (34), there are housed an expansion mechanism (31), a generator (33), and an output shaft (32). The expansion mechanism (31) is a generally-called rotary positive displacement fluid machinery. The generator (33) is arranged under the expansion mechanism (31) in the expander casing (34). The output shaft (32) is arranged vertically to connect the expansion mechanism (31) and the generator (33).

The inflow pipe (35) and the outflow pipe (36) are provided at the expander casing (34). Both the inflow pipe (35) and the outflow pipe (36) pass through the upper part of the expander casing (34). The terminal end of the inflow pipe (35) is connected directly to the expansion mechanism (31). The start end of the outflow pipe (36) is connected directly to the expansion mechanism (31). The expansion mechanism (31) expands the refrigerant flowing therein through the inflow pipe (35) and sends the expanded refrigerant to the outflow pipe (36). Namely, the refrigerant passing through the expander (30) passes through only the expansion mechanism (31) without flowing into the internal space of the expander casing (34).

In the bottom of the expander casing (34), refrigerator oil is reserved as the lubricant oil. Namely, an oil reservoir (37) is formed within the expander casing (34).

The output shaft (32) composes an oil supply mechanism for supplying the refrigerator oil from the oil reservoir (37) to the expansion mechanism (31). Though not shown, an axially extending oil supply path is formed inside the output shaft (32). The oil supply path is opened at the lower end of the output shaft (32) and serves as a generally-called centrifugal pump. The lower end of the output shaft (32) is dipped in the oil reservoir (37). When the output shaft (32) is rotated, the refrigerator oil is sucked by the operation of the centrifugal pump from the oil reservoir (37) into the oil supply path. The refrigerator oil sucked in the oil supply path is supplied to the expansion mechanism (31) for lubrication of the expansion mechanism (31).

An equalizing pipe (41) is provided between the compressor casing (24) and the expander casing (34). The equalizing pipe (41) composes an equalizing path (40). The equalizing pipe (41) is opened at one end thereof above the motor (23) in the internal space of the compressor casing (24) while being opened at the other end thereof between the expansion mechanism (31) and the generator (33) in the internal space of the expander casing (34). The internal space of the compressor casing (24) and the internal space of the expander casing (34) communicate with each other through the equalizing pipe (41).

An oil pipe (42) is also provided between the compressor casing (24) and the expander casing (34). The oil pipe (42) composes an oil distribution path. One end of the oil pipe (42) is connected to the lower part of the side face of the compressor casing (24). The one end of the oil pipe (42) is opened to the internal space of the compressor casing (24) at a level a predetermined level higher than the lower end of the drive shaft (22). During the usual operation, the oil level in the oil reservoir (27) in the compressor casing (24) is higher than the one end of the oil pipe (42). On the other hand, the other end of the oil pipe (42) is connected to the lower part of the side face of the expander casing (34). The other end of the oil pipe (42) is opened to the internal space of the expander casing (34) at a level a predetermined level higher than the lower end of the output shaft (32). During the usual operation, the oil level in the oil reservoir (37) in the expander casing (34) is higher than the other end of the oil pipe (42).

The oil pipe (42) includes an oil amount adjusting valve (52). The oil amount adjusting valve (52) is a solenoid valve opening/closing according to a signal from outside. An oil level sensor (51) is housed inside the expander casing (34). The oil level sensor (51) detects the oil level in the oil reservoir (37) in the expander casing (34) and serves as an oil level detector. A controller (53) is provided in the refrigerating apparatus. The controller (53) serves as control means for controlling the oil amount adjusting valve (52) on the basis of an output signal of the oil level sensor (51).

In the present embodiment, adjusting means (50) for adjusting the flow state of the refrigerator oil in the oil pipe (42) is composed of the oil amount adjusting valve (52), the oil level sensor (51), and the controller (53). The oil amount adjusting valve (52) serves as a control valve operated according to the output of the oil level sensor (51).

-Driving Operation-

Driving operations of the air conditioner (10) will be described. Herein, description will be given first of the driving operations in a cooling operation and a heating operation of the air conditioner (10), and then, be given next of that in an operation for adjusting each oil amount in the compressor (20) and the expander (30).

<Cooling Operation>

During the cooling operation, the first four-way switching valve (12) and the second four-way switching valve (13) are set as shown in FIG. 1, and a vapor compression refrigeration cycle is performed by circulating the refrigerant in the refrigerant circuit (11). The high pressure of the refrigeration cycle performed in the refrigerant circuit (11) is set higher than the critical pressure of carbon dioxide, the refrigerant.

In the compressor (20), the motor (23) drives and rotates the compression mechanism (21). The compression mechanism (21) compresses the refrigerant sucked through the suction pipe (25) and discharge it into the compressor casing (24). The high-pressure refrigerant in the compressor casing (24) is discharged from the compressor (20) through the discharge pipe (26). The refrigerant discharged from the compressor (20) is sent to the outdoor heat exchanger (14) to radiate heat to the outdoor air. The high-pressure refrigerant having radiated the heat in the outdoor heat exchanger (14) flows into the expander (30).

In the expander (30), the high-pressure refrigerant flowing in the expansion mechanism (31) through the inflow pipe (35) is expanded to drive and rotate the generator (33). The motive power generated by the generator (33) is supplied to the motor (23) of the compressor (20). The refrigerant expanded in the expansion mechanism (31) is sent out from the expander (30) through the outflow pipe (36). The refrigerant sent out from the expander (30) is sent to the indoor heat exchanger (15). In the indoor heat exchanger (15), the refrigerant flowing therein absorbs heat from indoor air to be evaporated, thereby cooling the indoor air. The low-pressure refrigerant flowing out from the indoor heat exchanger (15) flows into the suction pipe (25) of the compressor (20).

<Heating Operation>

During the heating operation, the first four-way switching valve (12) and the second four-way switching valve (13) are set as shown in FIG. 2, and a vapor compression refrigeration cycle is performed by circulating the refrigerant in the refrigerant circuit (11). Similarly to the cooling operation, the high pressure of this refrigeration cycle performed in the refrigerant circuit (11) is set higher than the critical pressure of carbon dioxide, the refrigerant.

In the compressor (20), the motor (23) drives and rotates the compression mechanism (21). The compression mechanism (21) compresses the refrigerant sucked through the suction pipe (25) and discharges it into the compressor casing (24). The high-pressure refrigerant in the compressor casing (24) is discharged from the compressor (20) through the discharge pipe (26). The refrigerant discharged from the compressor (20) is sent to the indoor heat exchanger (15). In the indoor heat exchanger (15), the refrigerant flowing therein radiates heat to indoor air to heat the indoor air. The high-pressure refrigerant having radiated the heat in the indoor heat exchanger (15) flows into the expander (30).

In the expander (30), the high-pressure refrigerant flowing in the expansion mechanism (31) through the inflow pipe (35) is expanded to drive and rotate the generator (33). The motive power generated by the generator (33) is supplied to the motor (23) of the compressor (20). The refrigerant expanded in the expansion mechanism (31) is sent out from the expander (30) through the outflow pipe (36). The refrigerant sent out from the expander (30) is sent to the outdoor heat exchanger (14). In the outdoor heat exchanger (14), the refrigerant flowing therein absorbs heat from outdoor air to be evaporated. The low-pressure refrigerant flowing out from the outdoor heat exchanger (14) flows into the suction pipe (25) of the compressor (20).

<Oil Amount Adjusting Operation>

First of all, during the operation of the compressor (20), the refrigerator oil is supplied from the oil reservoir (27) in the compressor casing (24) to the compression mechanism (21). While the refrigerator oil supplied to the compression mechanism (21) is utilized for lubrication of the compression mechanism (21), part of thereof is discharged together with the refrigerant into the internal space of the compressor casing (24). In the process of passing of the refrigerator oil discharged from the compression mechanism (21) together with the refrigerant through a slit between the rotor and the stator of the motor (23), a slit between the stator and the compressor casing (24), and the like, part thereof is separated from the refrigerant. The refrigerator oil separated from the refrigerant in the compressor casing (24) drops into the oil reservoir (27). On the other hand, the refrigerator oil not separated from the refrigerant flows outside the compressor (20) through the discharge pipe (26) together with the refrigerant.

During the operation of the expander (30), the refrigerator oil is supplied from the oil reservoir (37) in the expander casing (34) to the expansion mechanism (31). While the refrigerator oil supplied to the expansion mechanism (31) is utilized for lubrication of the expansion mechanism (31), part thereof is sent out from the expansion mechanism (31) together with the expanded refrigerant. The refrigerator oil sent out from the expansion mechanism (31) flows outside the expander (30) through the outflow pipe (36).

Thus, the refrigerator oil flows out from the compressor (20) and the expander (30) during the operation of the air conditioner (10). The refrigerator oil flowing out from the compressor (20) and the expander (30) is circulated in the refrigerant circuit (11) together with the refrigerant and is returned to the compressor (20) and the expander (30) again.

In the compressor (20), the refrigerator oil flowing in the refrigerant circuit (11) is sucked into the compression mechanism (21) through the suction pipe (25) together with the refrigerant. The refrigerator oil sucked in the compression mechanism (21) through the suction pipe (25) is discharged into the internal space of the compressor casing (24) together with the compressed refrigerant. As described above, part of the refrigerator oil discharged from the compression mechanism (21) together with the refrigerant is separated from the refrigerant when flowing in the internal space of the compressor casing (24) and is then returned to the oil reservoir (27). In other words, during the operation of the compressor (20), the refrigerator oil in the compressor casing (24) flows out through the discharge pipe (26) while at the same time the refrigerator oil sucked in the compression mechanism (21) through the suction pipe (25) is returned to the oil reservoir (27) in the compressor casing (24). Hence, the amount of the refrigerator oil reserved in the compressor casing (24) is secured in the compressor (20).

Referring to the expander (30), the refrigerator oil flowing in the refrigerant circuit (11) flows into the expansion mechanism (31) through the inflow pipe (35) together with the refrigerant. In contrast to that in the expander (30), the refrigerant expanded in the expansion mechanism (31) is sent outside the expander casing (34) directly through the outflow pipe (36). Accordingly, the refrigerator oil flowing in the expansion mechanism (31) together with the refrigerant is sent outside the expander casing (34) directly through the outflow pipe (36). In other words, in the expander (30), while the refrigerator oil flowing in the refrigerant circuit (11) flows into the expansion mechanism (31), this refrigerant is sent out from the expander casing (34) without being returned to the oil reservoir (37) in the expander casing (34). Further, in the expander (30), the refrigerator oil supplied from the oil reservoir (37) in the expander casing (34) to the expansion mechanism (31) is sent out from the expander (30) together with the refrigerant. Accordingly, the amount of the refrigerator oil reserved in the expander casing (34) decreases gradually in the operation of the expander (30).

When the amount of the refrigerator oil reserved in the expander casing (34) decreases, the oil level in the oil reservoir (37) lowers accordingly. The controller (53) opens the oil amount adjusting valve (52) when it judges on the basis of the output signal from the oil level sensor (51) that the oil level in the oil reservoir (37) lowers up to a given level. When the oil amount adjusting valve (52) is opened, the oil reservoir (27) in the compressor casing (24) and the oil reservoir (37) in the expander casing (34) communicate with each other.

In the state in which the amount of the refrigerator oil reserved in the expander casing (34) is less, the oil level in the oil reservoir (37) in the expander casing (34) is lower than that in the oil reservoir (27) in the compressor casing (24). The internal spaces of the compressor casing (24) and the expander casing (34) communicate with each other through the equalizing pipe (41) to equalize the inner pressures thereof to each other. Accordingly, the refrigerator oil flows from the oil reservoir (27) in the compressor casing (24) toward the oil reservoir (37) in the expansder casing (34) through the oil distribution path (42). The controller (53) closes the oil amount adjusting valve (52) when it judges on the basis of the output singal of the oil level sensor (51) that the oil level in the oil reservoir (37) rises up to a given level.

-Effects of Embodiment 1-

In the present embodiment, the compressor casing (24) and the expander casing (34) are connected to each other through the equalizing pipe (41) and the oil pipe (42). Accordingly, even when the refrigerator oil is distributed excessively to the compressor (20) in the operation of the air conditioner (10), the refrigerator oil can be supplied through the oil pipe (42) from the compressor (20) in which the refrigerator oil is excessive to the expander (30) in which the refrigerator oil is deficient. As a result, each amount of the refrigerator oil reserved in the compressor casing (24) and the expander casing (34) can be secured sufficiently to enable definite lubrication of the compression mechanism (21) and the expansion mechanism (31). Hence, in the present embodiment, damage caused due to insufficient lubrication of the compressor (20) or the expander (30) can be prevented to ensure the reliability of the air conditioner (10).

<Embodiment 2 of the Invention>

Embodiment 2 of the present invention will be described. An air conditioner (10) of the present embodiment includes the refrigerant circuit (11) in Embodiment 1 to which an oil separator (60) and an oil return pipe (62) are added. Herein, only the difference of the air conditioner (10) of the present embodiment from that of Embodiment 1 will be described.

Figure 4:
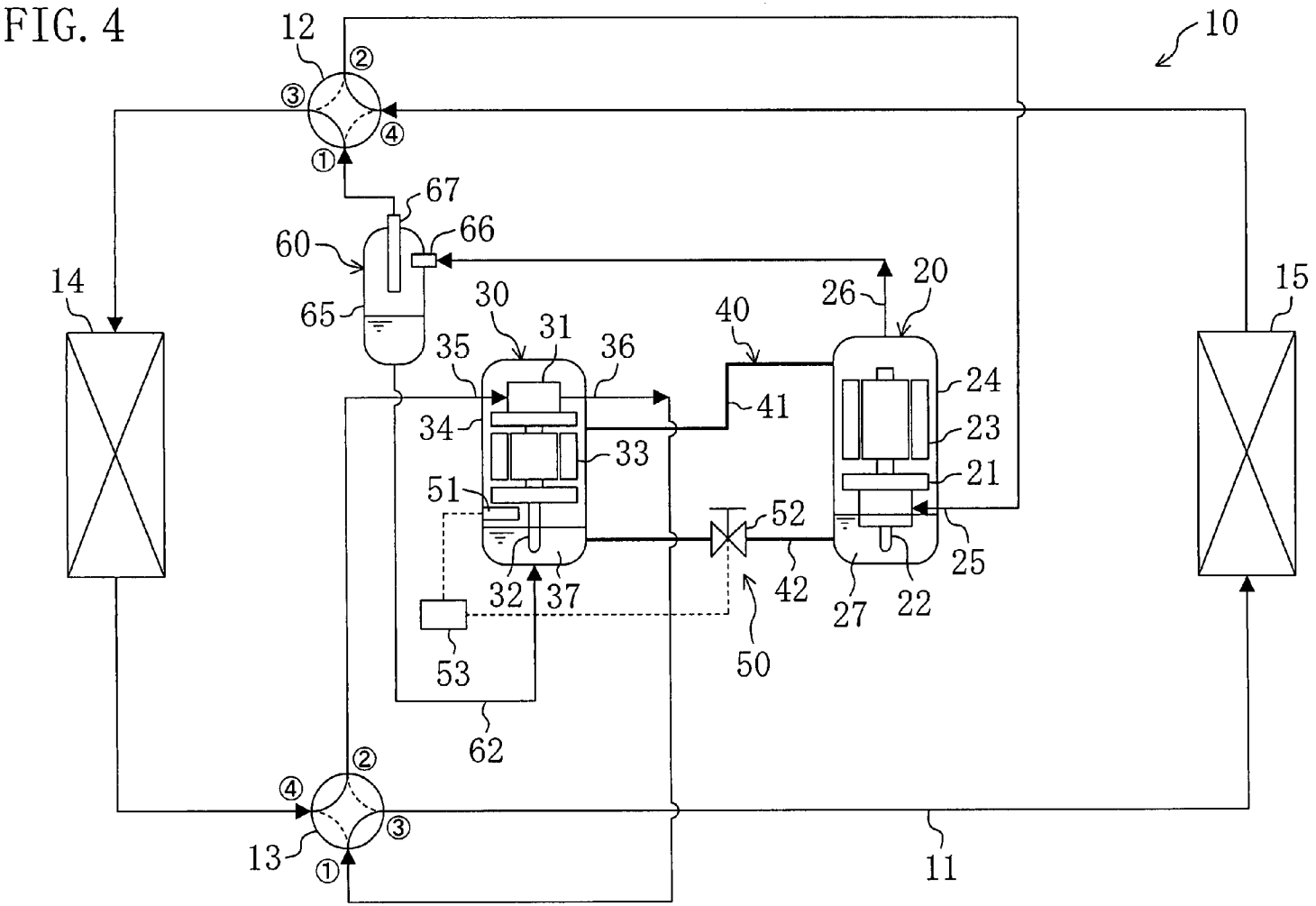
FIG. 4 is a refrigerant circuit diagram showing a construction of a refrigerant circuit in accordance with Embodiment 2.

As shown in FIG. 4, the oil separator (60) is arranged on the discharge side of the compressor (20). The oil separator (60) separates the refrigerator oil from the refrigerant discharged from the compressor (20). Specifically, the oil separator (60) includes a body member (65) in a form of a vertically cylindrical sealed container. An inlet pipe (66) and an outlet pipe (67) are provided at the body member (65). The inlet pipe (66) protrudes transversely from the body member (65) so as to pass through the upper part of the side wall of the body member (65). The outlet pipe (67) protrudes upward from the body member (65) so as to pass through the top of the body member (65). The inlet pipe (66) of the oil separator (60) is connected to the discharge pipe (26) of the compressor (20) while the outlet pipe (67) thereof is connected to the first port of the first four-way switching valve (12).

The oil return pipe (62) connects the oil separator (60) and the expander (30) to form an oil return path. The oil return pipe (62) is connected at one end thereof to the bottom of the body member (65) of the oil separator (60) while being connected at the other end thereof to the bottom of the expander casing (34). The internal space of the body member (65) of the oil separator (60) communicates with the oil reservoir (37) in the expander casing (34) through the oil return pipe (62).

-Driving Operation-

The driving operations of the air conditioner (10) of the present embodiment in the cooling operation and the heating operation are the same as those of the air conditioner (10) in Embodiment 1. Herein, an oil amount adjusting operation performed in the air conditioner (10) of the present embodiment will be described.

The refrigerator oil discharged from the compressor (20) together with the refrigerant flows into the oil separator (60), is separated from the refrigerant, and is then reserved in the bottom of the body member (65). The refrigerator oil reserved in the body member (65) is supplied to the oil reservoir (37) in the expander casing (34) through the oil return pipe (62). On the other hand, the refrigerator oil flowing out from the expander (30) together with the refrigerant flows in the refrigerant circuit (11) together with the refrigerant and is sucked into the compression mechanism (21) of the compressor (20). The refrigerator oil sucked in the compression mechanism (21) is discharged into the internal space of the compression engine casing (24) together with the compressed refrigerant, and part thereof drops into the oil reservoir (27) in the compressor casing (24).

Thus, in the present embodiment, the refrigerator oil flowing out from the compressor (20) is supplied into the expander casing (34) through the oil separator (60) and the oil return pipe (62) while the refrigerator oil flowing out from the expander (30) is supplied into the compressor casing (24). The outflow amount and the return amount of the refrigerator oil is not necessarily always equal to each other in each of the compressor (20) and the expander (30), of course. Therefore, the controller (53) controls the oil amount adjusting valve (52) on the basis of the output signal of the oil level sensor (51) in the present embodiment also.

Specifically, the controller (53) opens the oil amount adjusting valve (52) when it judges that the oil level in the oil reservoir (37) in the expander casing (34) is equal to or lower than a predetermined lower limit level. In this state, the oil level in the oil reservoir (37) in the expander casing (34) is lower than that in the oil reservoir (27) in the compressor casing (24). Accordingly, the refrigerator oil in the compressor casing (24) flows into the expander casing (34) through the oil distribution path (42). The controller (53) closes the oil amount adjusting valve (52) when it judges that the oil level in the oil reservoir (37) in the expander casing (34) rises up to a predetermined reference level.

The controller (53) also opens the oil amount adjusting valve (52) when it judges that the oil level in the oil reservoir (37) in the expander casing (34) is equal to or higher than a predetermine upper limit level. In this state, the oil level in the oil reservoir (37) in the expander casing (34) is higher than that in the oil reservoir (27) in the compressor casing (24). Accordingly, the refrigerator oil in the expander casing (34) flows into the compressor casing (24) through the oil pipe (42). The controller (53) closes the oil amount adjusting valve (52) when it judges that the oil level in the oil reservoir (37) in the expander casing (34) lowers to a predetermined reference level.

-Effects of Embodiment 2-

In the present embodiment, the refrigerator oil is collected in the oil separator (60) arranged downstream of the compressor (20). Herein, the refrigerant having passed through the oil separator (60) after being discharged from the compressor (20) passes through the outdoor heat exchanger (14) in the cooling operation while on the other hand passing through the indoor heat exchanger (15) in the heating operation. Accordingly, the arrangement of the oil separator (60) downstream of the compressor (20) leads to reduction in the amount of refrigerator oil flowing into either the outdoor heat exchanger (14) or the indoor heat exchanger (15) whichever serves as a gas cooler. Hence, in the present embodiment, the situation that the lubricant oil inhibits heat exchange between the refrigerant and the air in a heat exchanger serving as a gas cooler can be suppressed to allow the heat exchanger to exert its performance fully.

-Modified Example 1 of Embodiment 2-

The equalizing pipe (41) may be omitted from the refrigerant circuit (11) in the air conditioner (10) of the present embodiment.

Figure 5:
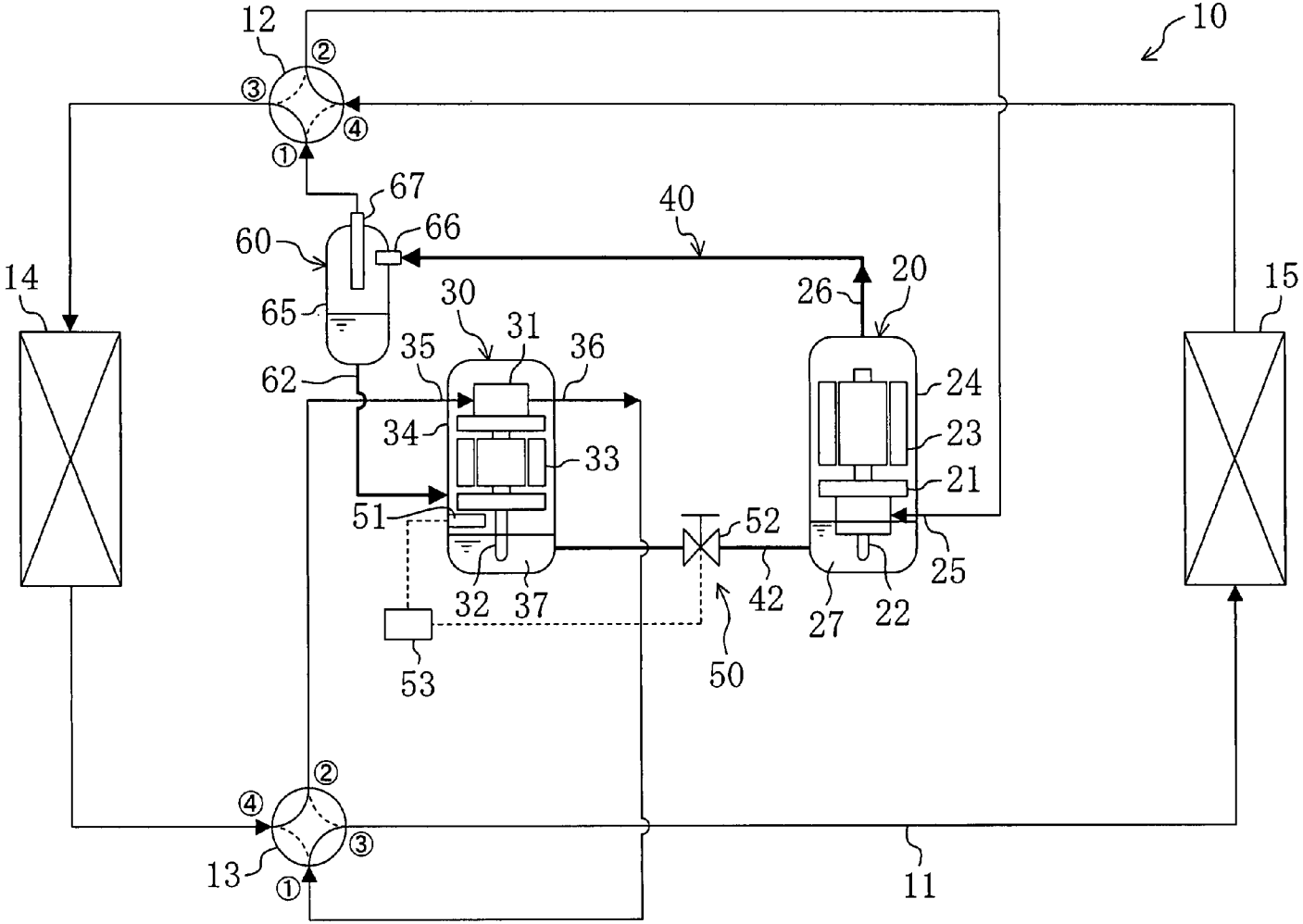
FIG. 5 is a refrigerant circuit diagram showing a construction of a refrigerant circuit in accordance with Modified Example 1 of Embodiment 2.

As shown in FIG. 5, in the present modified example, the connection level of the oil return pipe (62) to the expander casing (34) is changed. The terminal end of the oil return pipe (62) is opened to a part which is always upper than the oil level in the oil reservoir (37) in the expander casing (34). The part in the internal space of the expander casing (34) which is upper than the oil reservoir (37) communicates with the body member (65) of the oil separator (60) through the oil return pipe (62). The body member (65) of the oil separator (60) communicates with the part of the internal space of the compressor casing (24) which is upper than the oil reservoir (27) through a pipe connecting the inlet pipe (66) thereof and the discharge pipe (26) of the compressor (20).

Thus, in the refrigerant circuit (11) of the present modified example, the internal spaces of the compressor casing (24) and the expander casing (34) communicate with each other through the pipe connecting the discharge pipe (26) of the compressor (20) and the inlet pipe (66) of the oil separator (60), the body member (65) of the oil separator (60), and the oil return pipe (62). In other words, in the refrigerant circuit (11) of the present modified example, the pipe connecting the discharge pipe (26) of the compressor (20) and the inlet pipe (66) of the oil separator (60), the body member (65) of the oil separator (60), and the oil return pipe (62) form an equalizing path (40).

In the present modified example, the pipe connecting the compressor (20) and the oil separator (60) and the oil return pipe (62) serve as the equalizing path (40) to eliminate the need to provide the equalizing pipe (41) for forming the equalizing path (40), thereby keeping the simple construction of the refrigerant circuit (11).

-Modified Example 2 of Embodiment 2-

The oil separator (60) may be connected to the compressor casing (24) rather than to the expander casing (34) in the refrigerant circuit (11) of the present modified example.

Figure 6:
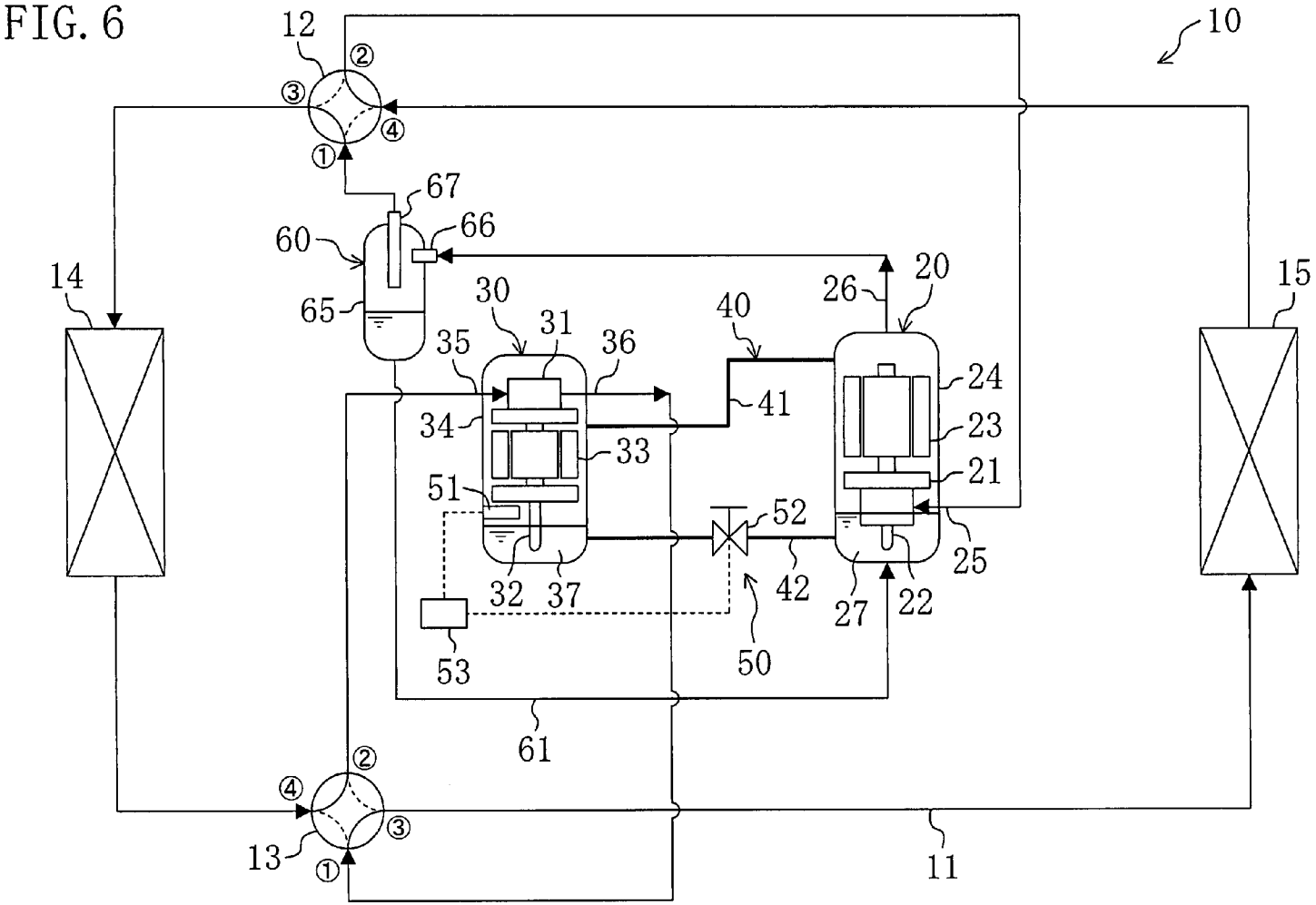
FIG. 6 is a refrigerant circuit diagram showing a construction of a refrigerant circuit in accordance with Modified Example 2 of Embodiment 2.

As shown in FIG. 6, in the refrigerant circuit (11) of the present modified example, the body member (65) of the oil separator (60) and the compressor casing (24) are connected to each other through an oil return pie (61). The oil return pipe (61) is connected at one end thereof to the bottom of the body member (65) of the oil separator (60) while being connected at the other end thereof to the bottom of the compressor casing (24). The oil return pipe (61) composes an oil return path for allowing the body member (65) of the oil separator (60) and the oil reservoir (27) in the compressor casing (24) to communicate with each other.

In the refrigerant circuit (11) of the present modified example, the refrigerator oil discharged from the compressor (20) together with the refrigerant is separated from the refrigerant in the oil separator (60) and is then returned to the oil reservoir (27) in the compressor casing (24) through the oil return pipe (61). The refrigerator oil flowing out from the expander (30) together with the refrigerant is sucked into the compression mechanism (21) of the compressor (20), and part thereof drops into the oil reservoir (27) in the compressor casing (24). Namely, both the refrigerator oil flowing out from the compressor (20) and the refrigerator oil flowing out from the expander (30) are collected once in the oil reservoir (27) in the compressor casing (24) in the present modified example.

The controller (53) opens the oil amount adjusting valve (52) when it judges that the oil level in the oil reservoir (37) in the expander casing (34) is equal to or lower than a predetermined lower limit level to allow the refrigerator oil in the compressor casing (24) to be supplied into the expander casing (34). The controller (53) closes the oil amount adjusting valve (52) when it judges that the oil level in the oil reservoir (37) in the expander casing (34) rises up to a predetermined reference level. The operation of the controller (53) on the oil amount adjusting valve (52) in this way results in distribution of the refrigerator oil collected in the oil reservoir (27) in the compressor casing (24) to the oil reservoir (37) in the expander casing (34).

-Modified Example 3 of Embodiment 2-

In the refrigerant circuit (11) of the present modified example, the oil separator (60) may be connected to the suction side of the compressor (20) rather than to the expander casing (34).

Figure 7:
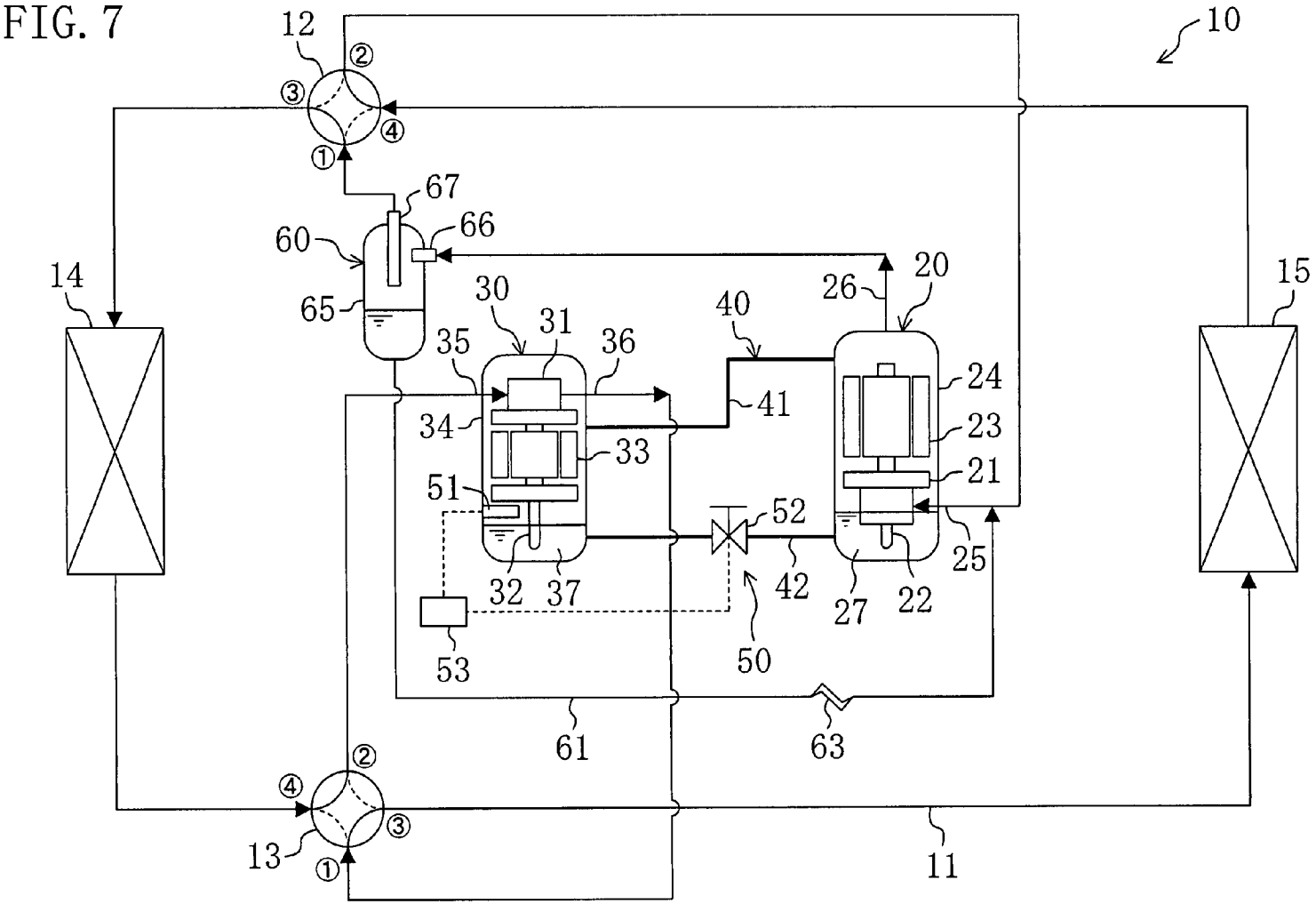
FIG. 7 is a refrigerant circuit diagram showing a construction of a refrigerant circuit in accordance with Modified Example 3 of Embodiment 2.

As shown in FIG. 7, the body member (65) of the oil separator (60) and the suction pipe (25) of the compressor (20) are connected to each other through the oil return pipe (61) in the refrigerant circuit (11) of the present modified example. The oil return pipe (61) is connected at one end thereof to the bottom of the body member (65) of the oil separator (60) while being connected at the other end thereof to a pipe connecting the suction pipe (25) of the compressor (20) and the second port of the first four-way switching valve (12). In the middle of the oil return pipe (61), a capillary tube (63) is provided for reducing the pressure of the refrigerator oil. The oil return pipe (61) composes an oil return path for introducing the refrigerator oil from the body member (65) of the oil separator (60) to the oil reservoir (27) in the compressor casing (24).

In the refrigerant circuit (11) of the present modified example, the refrigerator oil discharged from the compressor (20) together with the refrigerant is separated from the refrigerant in the oil separator (60) and flows then into the oil return pipe (61). The refrigerator oil flowing in the oil return pipe (61) is reduced in pressure when passing through the capillary tube (63), flows into the suction side of the compressor (20), and passes then through the suction pipe (25) together with the refrigerant to be sucked into the compression mechanism (21). The refrigerator oil flowing out from the expander (30) together with the refrigerant is also sucked into the compression mechanism (21) through the suction pipe (25) of the compressor (20). The refrigerator oil sucked in the compression mechanism (21) is discharged into the internal space of the compressor casing (24) together with the compressed refrigerant. Part thereof drops into the oil reservoir (27) in the compressor casing (24). Namely, both the refrigerator oil flowing out from the compressor (20) and the refrigerator oil flowing out from the expander (30) are collected once in the oil reservoir (27) in the compressor casing (24).

The controller (53) controls the oil amount adjusting valve (52) by the same manner as in Modified Example 2, and therefore, the description thereof is omitted.

<Embodiment 3 of the Invention>

Embodiment 3 of the present invention will be described. An air conditioner (10) of the present embodiment includes the refrigerant circuit (11) of Embodiment 1 to which an oil separator (70) and an oil return pipe (71) are added. Herein, only the difference of the air conditioner (10) of the present embodiment from that of Embodiment 1 will be described.

Figure 8:
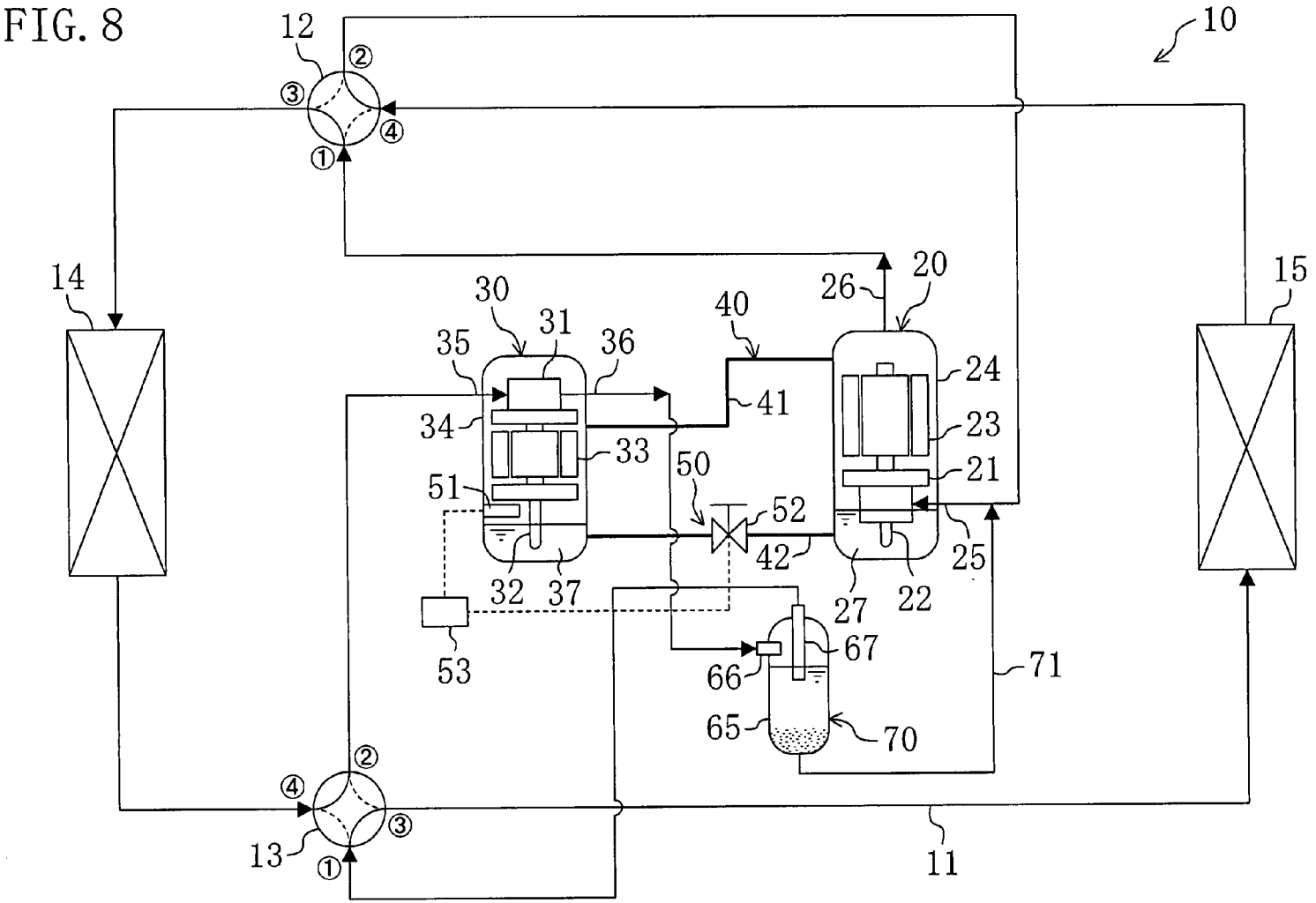
FIG. 8 is a refrigerant circuit diagram showing a construction of a refrigerant circuit in accordance with Embodiment 3.

As shown in FIG. 8, the oil separator (70) is arranged on the outflow side of the expander (30). The oil separator (70) itself has the same construction as the oil separator (60) in Embodiment 2. Specifically, the oil separator (70) includes a body member (65), an inlet pipe (66), and an outlet pipe (67). The inlet pipe (66) of the oil separator (70) is connected to the outflow pipe (36) of the expander (30) while the outlet pipe (67) thereof is connected to the first port of the second four-way switching valve (13).

The oil return pipe (71) connects the oil separator (70) and the suction pipe (25) of the compressor (20) to form an oil return path. The oil return pipe (71) is connected at one end thereof to the bottom of the body member (65) of the oil separator (70) while being connected at the other end thereof (71) to a pipe connecting the suction pipe (25) of the compressor (2) and the second port of the first four-way switching valve (12).

-Driving Operation-

The driving operations of the air conditioner (10) of the present embodiment in the cooling operation and the heating operation are the same as those of the air conditioner (10) of Embodiment 1. Herein, an oil amount adjusting operation performed in the air conditioner (10) of the present embodiment will be described.

The refrigerator oil discharged from the compressor (20) together with the refrigerant flows in the refrigerant circuit (11) through the inflow pipe (35) of the expander (30) into the expansion mechanism (31). The refrigerator oil flowing in the expansion mechanism (31) flows out from the expander (30)

through the outflow pipe (36) together with the refrigerator oil supplied to the expansion mechanism (31) from the oil reservoir (37) of the expander casing (34).

The refrigerator oil flowing out from the expander (30) flows into the body member (65) of the oil separator (70) together with the expanded refrigerant in a gas-liquid two-phase state. The mixture of the liquid refrigerant and the refrigerator oil is reserved in the lower part of the body member (65) while the gas refrigerant is layered thereabove. The specific gravity of the refrigerator oil used in the present embodiment is larger than that of the liquid refrigerant. Accordingly, the ratio of the refrigerator oil becomes large as it goes down while the ratio of the liquid refrigerant becomes large as it goes up in such a liquid reservoir in the body member (65).

The outlet pipe (67) of the oil separator (70) is dipped at the lower end thereof in the liquid reservoir of the body member (65). The liquid refrigerant layered thereabove in the liquid reservoir flows out from the body member (65) through the outlet pipe (67) and is then supplied to the indoor heat exchanger (15) in the cooling operation while on the other hand being supplied to the outdoor heat exchanger (14) in the heating operation.

The refrigerator oil reserved in the body member (65) of the oil separator (70) flows into the suction side of the compressor (20) through the oil return pipe (71) and is then sucked into the compression mechanism (21) through the suction pipe (25) together with the refrigerant. The refrigerator oil sucked in the compression mechanism (21) is discharged into the internal space of the compressor casing (24) together with the compressed refrigerant, and part thereof drops into the oil reservoir (27) in the compressor casing (24). Namely, in the present embodiment, both the refrigerator oil flowing out from the compressor (20) and the refrigerator oil flowing out from the expander (30) are once collected in the oil reservoir (27) in the compressor casing (24).

The controller (53) opens the oil amount adjusting valve (52) when it judges that the oil level in the oil reservoir (37) in the expander casing (34) is equal to or lower than a predetermined lower limit level. In this state, the oil level in the oil reservoir (37) in the expander casing (34) is lower than that in the oil reservoir (27) in the compressor casing (24). Accordingly, the refrigerator oil in the compressor casing (24) flows into the expander casing (34) through the oil pipe (42). The controller (53) closes the oil amount adjusting valve (52) when it judges that the oil level in the oil reservoir (37) in the expander casing (34) rises up to a predetermined reference level. The operation of the controller (53) on the oil amount adjusting valve (52) in this way results in distribution of the refrigerator oil collected in the oil reservoir (27) in the compressor casing (24) to the oil reservoir (37) in the expander casing (34).

-Effects of Embodiment 3-

In the present embodiment, the lubricant oil is collected in the oil separator (70) arranged on the outflow side of the expander (30). Herein, the refrigerant sent out from the expander (30) and having passed through the oil separator (70) passes through the indoor heat exchanger (15) in the cooling operation while on the other hand passing through the outdoor heat exchanger (14) in the heating operation. Accordingly, arrangement of the oil separator (70) downstream of the expander (30) results in reduction in the amount of the refrigerator oil flowing into the outdoor heat exchanger (14) or the indoor heat exchanger (15) whichever functions as an evaporator. Hence, in the present embodiment, the situation that the lubricant oil inhibits heat exchange between the refrigerant and the air in a heat exchanger functioning as an evaporator can be suppressed to allow the heat exchanger to exert its performance fully.

<Embodiment 4 of the Invention>

Embodiment 4 of the present invention will be described. In an air conditioner (10) of the present embodiment, a compressor (20) is changed from that in the Embodiment 1. Herein, only the difference of the air conditioner (10) of the present embodiment from that of Embodiment 1 will be described.

Figure 9:
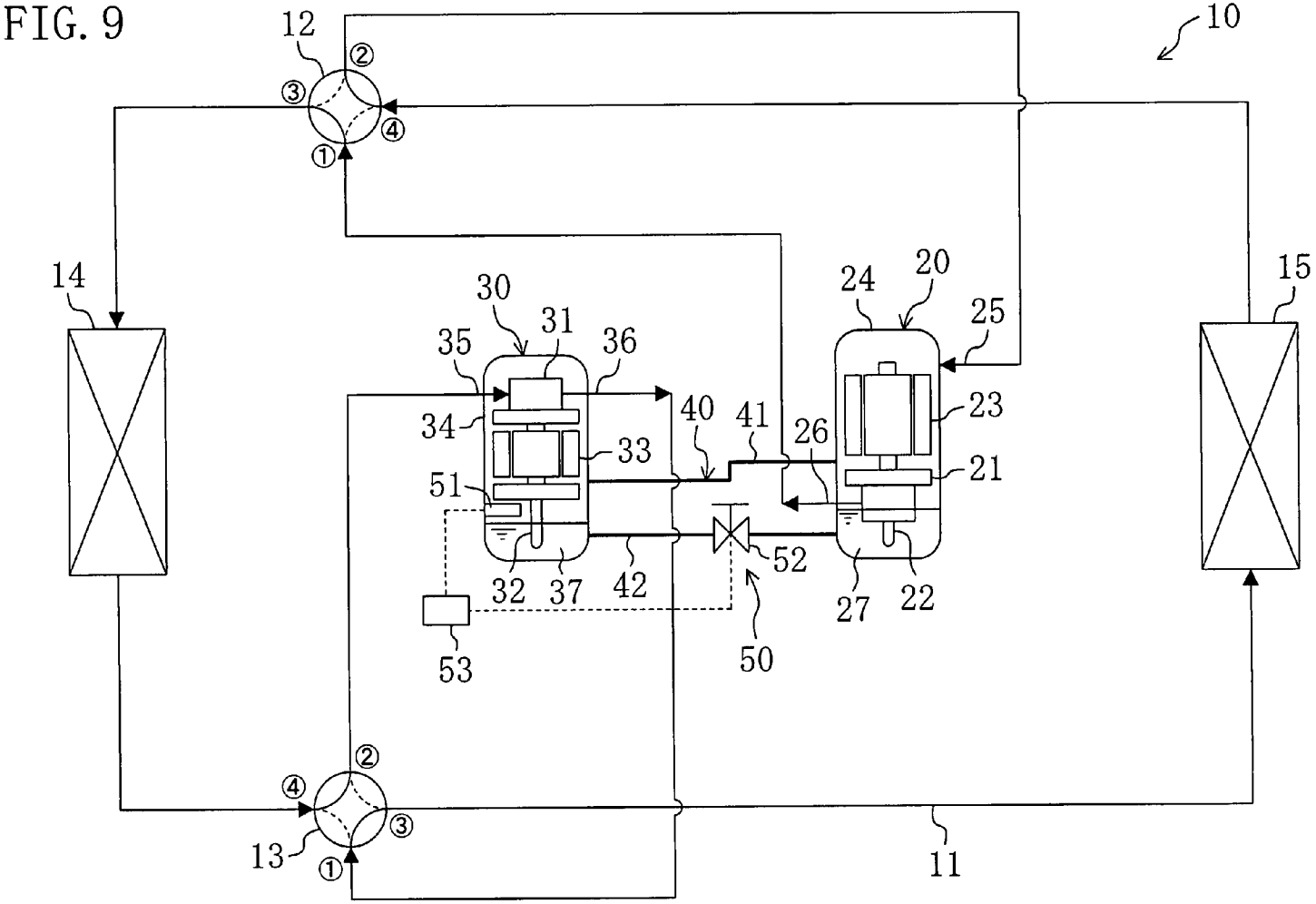
FIG. 9 is a refrigerant circuit diagram showing a construction of a refrigerant circuit in accordance with Embodiment 4.
Figure 10:
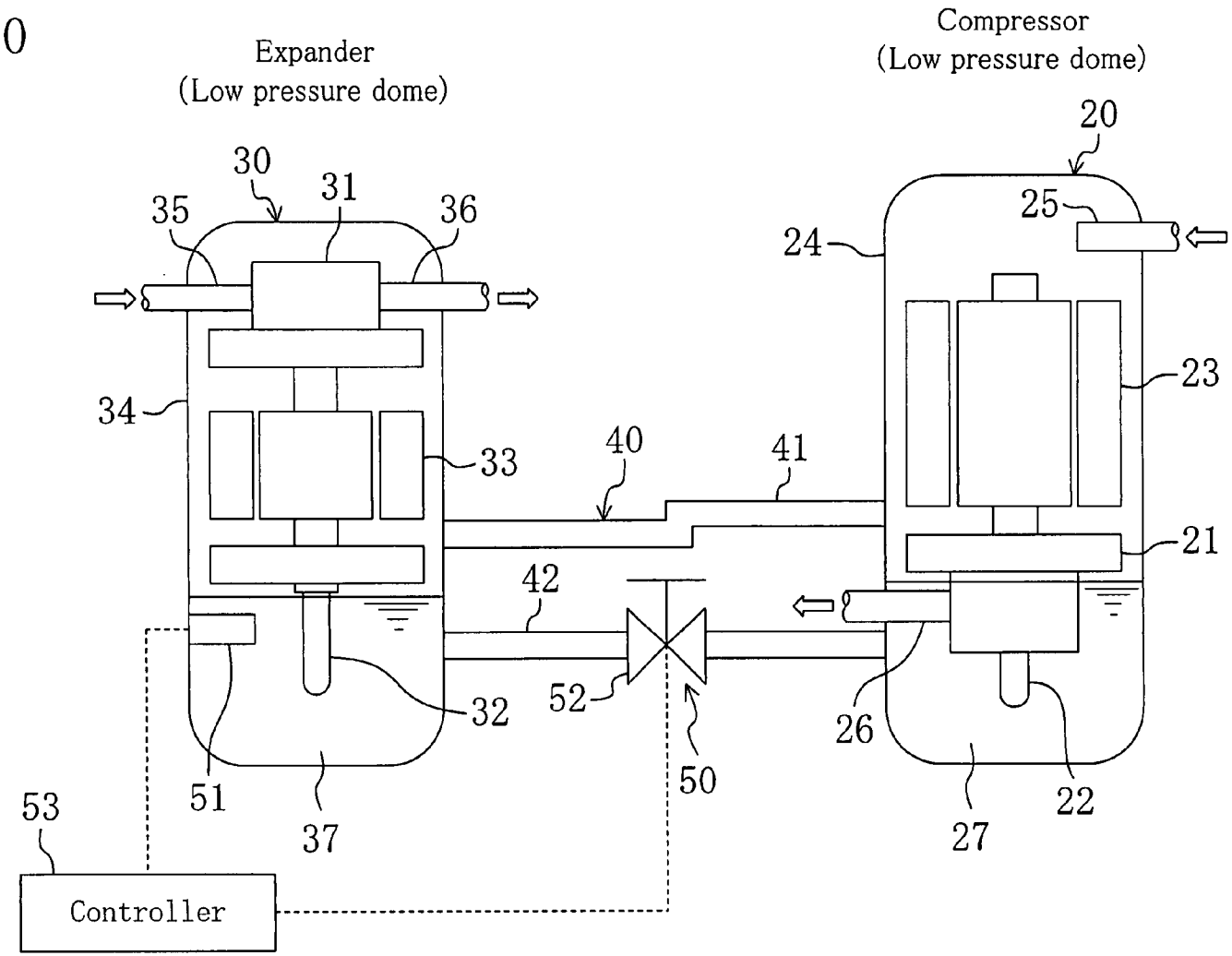
FIG. 10 is an enlarged view of a main part of the refrigerant circuit in accordance with Embodiment 4.

As shown in FIG. 9 and FIG. 10, a compressor (20) in the present embodiment is a generally-called hermetic compressor of low-pressure dome type. In the compressor (20), a suction pipe (25) passes through the upper part of the compressor casing (24), and the terminal end thereof is opened to the space above the motor (23) in the compressor casing (24). On the other hand, a discharge pipe (26) passes through the lower part of the compressor casing (24), and the start end thereof is connected directly to the compression mechanism (21). It is the same as in Embodiment 1 that the compression mechanism (21) composes a rotary positive displacement fluid machinery and that the drive shaft (22) serves as an oil supply mechanism.

Similarly to Embodiment 1, an equalizing pipe (41) is provided between the compressor casing (24) and the expander casing (34). The connection level of the equalizing pipe (41) to the compressor casing (24) is different from that in Embodiment 1. Specifically, one end of the equalizing pipe (41) connected to the compressor casing (2) is opened to the space between the compression mechanism (21) and the motor (23) in the internal space of the compressor casing (24). It is the same as in Embodiment 1 that the oil pipe (42) is provided between the compressor casing (24) and the expander casing (34) and that the oil amount adjusting valve (52) is provided in the oil pipe (42).

-Driving Operation-

The driving operations of the air conditioner (10) of the present embodiment in the cooling operation and the heating operation are the same as those of the air conditioner (10) of Embodiment 1. Herein, an oil amount adjusting operation performed in the air conditioner (10) of the present embodiment will be described.

The refrigerator oil discharged from the compressor (20) together with the refrigerant flows in the refrigerant circuit (11) through the inflow pipe (35) of the expander (30) into the expansion mechanism (31). The refrigerator oil flowing in the expansion mechanism (31) flows out from the expander (30) through the outflow pipe (36) together with the refrigerator oil supplied to the expansion mechanism (31) from the oil reservoir (37) in the expander casing (34). The refrigerator oil flowing out from the expansion mechanism (31) flows in the refrigerant circuit (11) together with the refrigerant into the internal space of the compressor casing (24) through the suction pipe (25) of the compressor (20). In the process of passing through the gap between the rotor and the stator of the motor (23), the gap between the stator and the compressor casing (24), and the like, the refrigerator oil flowing in the compressor casing (24) together with the refrigerant is separated from the refrigerant. The thus separated refrigerator oil drops into the oil reservoir (27). In this way, both the refrigerator oil flowing out from the compressor (20) and the refrigerator oil flowing out from the expander (30) are collected once in the oil reservoir (27) in the compressor casing (24).

The controller (53) controls the oil amount adjusting valve (53) by the same manner as in Embodiment 3. Namely, the controller (53) opens the oil amount adjusting valve (52) when it judges that the oil level in the oil reservoir (37) in the expander casing (34) is equal to or lower than a predetermined lower limit level and closes the oil amount adjusting valve (52) when it judges that the oil level in the oil reservoir (37) in the expander casing (34) rises up to a predetermined reference level.

In the present embodiment, the internal space of the compressor casing (24) and the internal space of the expander casing (34) communicate with each other through the equalizing pipe (41) so that the inner pressure of the expander casing (34) is almost equal to the pressure of the refrigerant sucked into the compressor casing (24). Accordingly, when the oil amount adjusting valve (52) is opened in the state where the refrigerator oil is reserved excessively in the compressor casing (24), the refrigerator oil flows from the compressor casing (24) toward the expander casing (34) through the oil pipe (42). In other words, the refrigerator oil collected in the oil reservoir (27) in the compressor casing (24) is distributed to the oil reservoir (37) in the expander casing (34).

-Effects of Embodiment 4-

In the present embodiment, the expander casing (34) communicates through the equalizing pipe (4) with the compressor casing (24) filled with the refrigerant before being sucked into the compression mechanism (21).

Herein, in the refrigerant circuit (11), the heat exchanger functioning as an evaporator is arranged downstream of the expander (30). It is desirable for securing the absorption amount of the heat of the refrigerant in a heat exchanger functioning as an evaporator to set the enthalpy of the refrigerant flowing out from the expander (30) low as far as possible. On the other hand, the refrigerant before being sucked into the compression mechanism (21) is lower in temperature than that after being compressed by the compression mechanism (21).

In the present embodiment, since the expander casing (34) communicates with the compressor casing (24) filled with the refrigerant before being sucked into the compression mechanism (21), the temperature inside the compressor casing (24) is not so high. For this reason, the amount of heat that invades the refrigerant expanded in the compression mechanism (31) can be suppressed, thereby suppressing the enthalpy of the refrigerant flowing out from the compressor (30) low. Hence, in the present embodiment, the absorption amount of the heat of the refrigerant in a heat exchanger functioning as an evaporator can be secured sufficiently.

<Embodiment 5 of the Invention>

Embodiment 5 of the present invention will be described. An air conditioner (10) of the present embodiment includes the refrigerant circuit (11) of Embodiment 4 to which an oil separator (60) and an oil return pipe (62) are added. Only the difference of the air conditioner (10) of the present embodiment from that of Embodiment 4 will be described.

Figure 11:
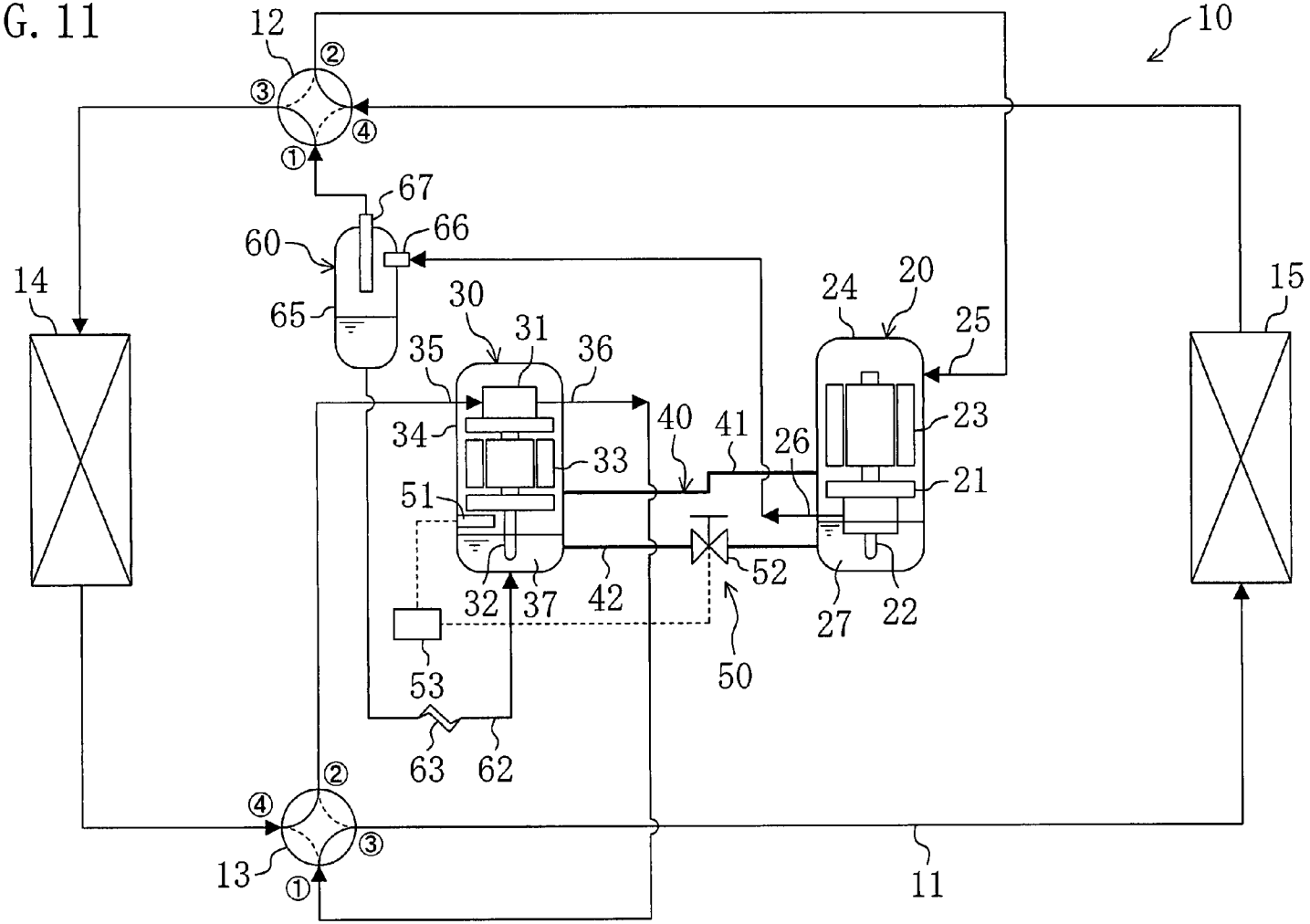
FIG. 11 is a refrigerant circuit-diagram showing a construction of a refrigerant circuit in accordance with Embodiment 5.

As shown in FIG. 11, the oil separator (60) is arranged on the discharge side of the compressor (20). The oil return pipe (62) connects the body member (65) of the oil separator (60) and the bottom of the expander casing (34). Each construction of the oil separator (60) and the oil return pipe (62) and the arrangement thereof in the refrigerant circuit (11) are the same as those in Embodiment 2 (see FIG. 4). Wherein, the oil return pipe (62) in the present embodiment includes a capillary tube (63) for reducing the pressure of the refrigerator oil. The oil return pipe (62) composes an oil return path for introducing the refrigerator oil from the body member (65) of the oil separator (60) to the oil reservoir (37) in the expander casing (34).

-Driving Operation-

The driving operations of the air conditioner (10) of the present embodiment in the cooling operation and the heating operation are the same as those of the air conditioner (10) of Embodiment 4. Herein, an oil amount adjusting operation performed in the air conditioner (10) of the present embodiment will be described.

In the present embodiment, similarly to the case in Embodiment 2, the refrigerator oil flowing out from the compressor (20) is supplied into the expander casing (34) through the oil separator (60) and the oil return pipe (62) while the refrigerator oil flowing out from the expander (30) is supplied into the compressor casing (24).

The controller (53) in the present embodiment performs the same operation as that in Embodiment 2. Namely, the controller (53) opens the oil amount adjusting valve (53) when it judges that the oil level in the oil reservoir (37) in the expander casing (34) is equal to or lower than a predetermined lower limit level and closes the oil amount adjusting valve (53) when it judges that the oil level in the oil reservoir (37) in the expander casing (34) rises up to a predetermined reference level. As well, the controller (53) opens the oil amount adjusting valve (53) when it judges that the oil level in the oil reservoir (37) in the expander casing (34) is equal to or higher than a predetermined upper limit level and closes the oil amount adjusting valve (53) when it judges that the oil level in the oil reservoir (37) in the expander casing (34) lowers up to a predetermined reference level.

-Effects of Embodiment 5-

According to the present embodiment, the same effects as those in Embodiment 2 can be obtained. Specifically, since the oil separator (60) is arranged on the discharge side of the compressor (20) for separating the refrigerator oil from the refrigerant in the present embodiment, the situation that the lubricant oil inhibits heat exchange between the refrigerant and the air in a heat exchanger functioning as a gas cooler can be suppressed to allow the heat exchanger to exert its performance fully.

-Modified Example of Embodiment 5-

The oil separator (60) may be connected to the compressor casing (24) rather than to the expander casing (34) in the refrigerant circuit (11) in the present embodiment.

Figure 12:
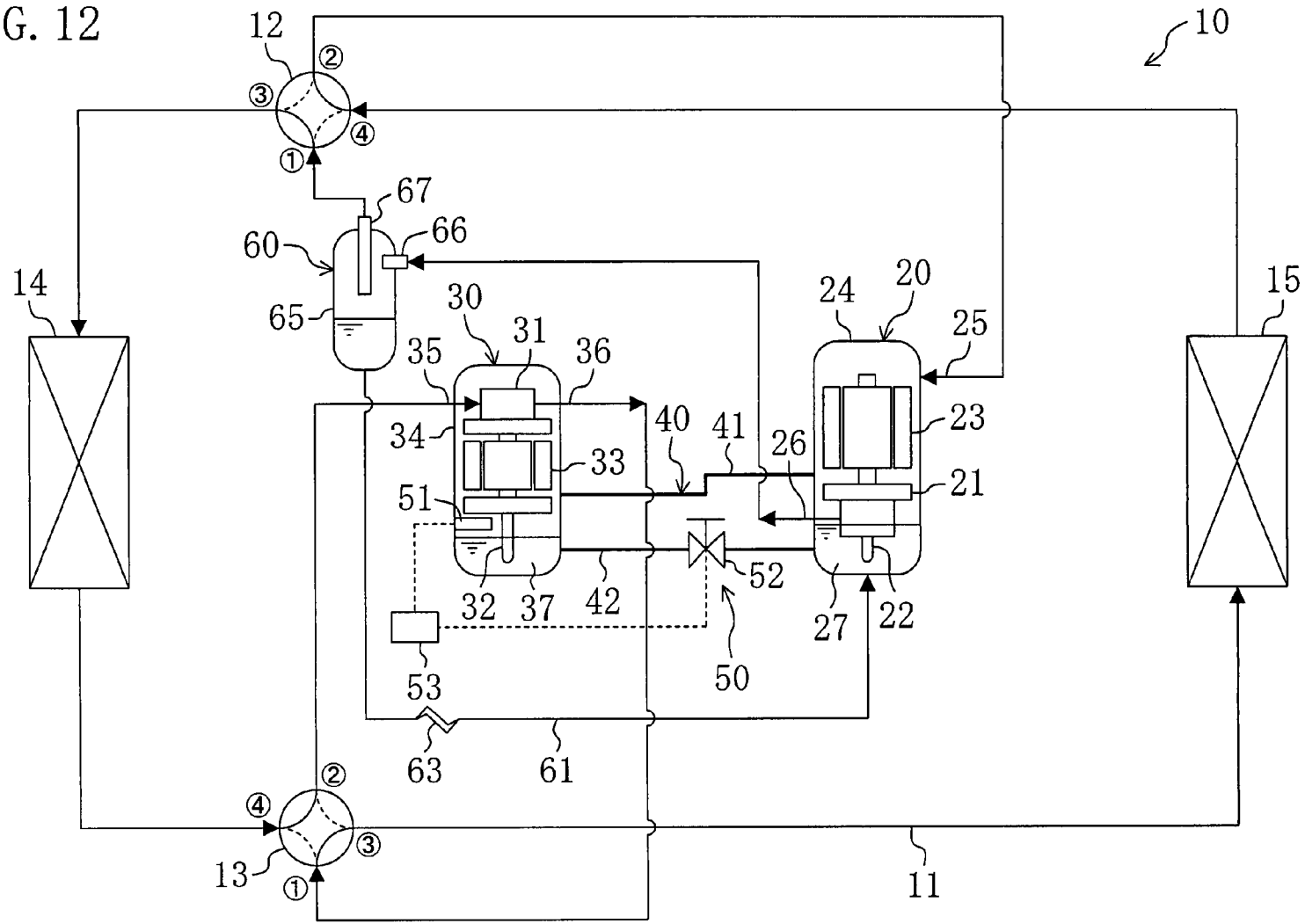
FIG. 12 is a refrigerant circuit diagram showing a construction of a refrigerant circuit in accordance with a modified example of Embodiment 5.

As shown in FIG. 12, in the refrigerant circuit (11) of the present modified example, the body member (65) of the oil separator (60) and the compressor casing (24) are connected to each other through an oil return pipe (61). The oil return pipe (61) is connected at one end thereof to the bottom of the body member (65) of the oil separator (60) while being connected at the other end thereof to the bottom of the compressor casing (24). The oil return pipe (61) includes a capillary tube (63) for reducing the pressure of the refrigerator oil flowing therein. The oil return pipe (61) composes an oil return path for allowing the body member (65) of the oil separator (60) and the oil reservoir (27) in the compressor casing (24) to communicate with each other.

In the refrigerant circuit (11) of the present modified example, the refrigerator oil discharged from the compressor (20) together with the refrigerant is separated from the refrigerant in the oil separator (60) and is then returned to the oil reservoir (27) in the compressor casing (24) through the oil return pipe (61). The refrigerator oil flowing out from the expander (30) together with the refrigerant flows into the oil reservoir (27) in the compressor casing (24). Namely, both the refrigerator oil flowing out from the compressor (20) and the refrigerator oil flowing out from the expander (30) are collected once in the oil reservoir (27) in the compressor casing (24).

The controller (53) opens the oil amount adjusting valve (52) when it judges that the oil level in the oil reservoir (37) in the expander casing (34) becomes equal to or lower than a predetermined lower limit level to supply the refrigerator oil in the compressor casing (24) to the expander casing (34). The controller (53) closes the oil amount adjusting valve (52) when it judges that the oil level in the oil reservoir (37) in the expander casing (34) rises up to a predetermined reference level. The operation of the controller (53) on the oil amount adjusting valve (52) in this way results in distribution of the refrigerator oil collected in the oil reservoir (27) in the compressor casing (24) to the oil reservoir (37) in the expander casing (34).

<Embodiment 6 of the Invention>

Embodiment 6 of the present invention will be described. An air conditioner (10) of the present embodiment includes the refrigerant circuit (11) of Embodiment 4 to which an oil separator (75) and an oil return pipe (75) are added. Herein, only the difference of the air conditioner (10) of the present invention from that of Embodiment 4 will be described.

Figure 13:
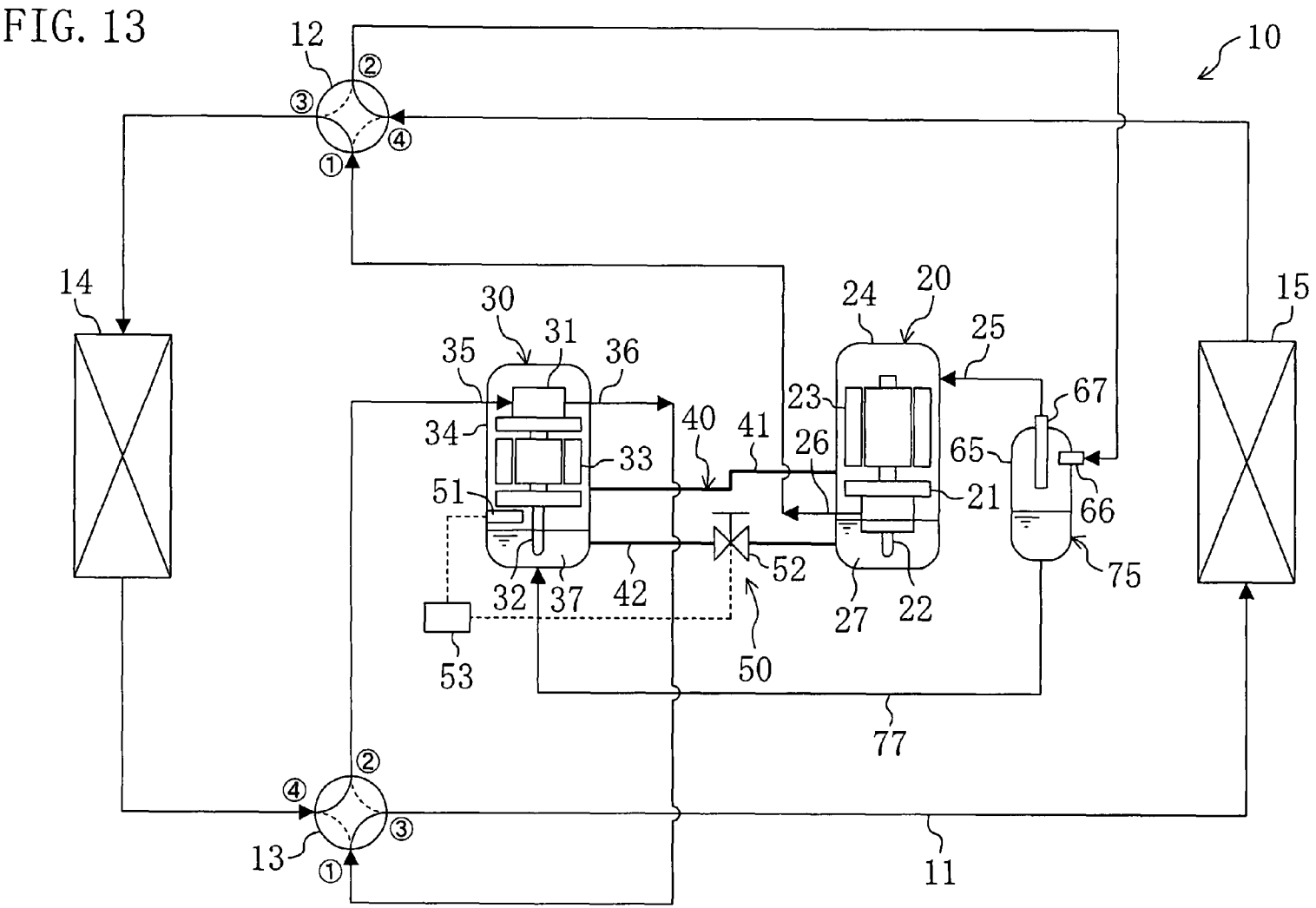
FIG. 13 is a refrigerant circuit diagram showing a construction of a refrigerant circuit in accordance with Embodiment 6.

As shown in FIG. 13, the oil separator (75) is arranged on the suction side of the compressor (20). The oil separator (75) itself has the same construction as the oil separator (60) in Embodiment 2. Specifically, the oil separator (75) includes a body member (65), an inlet pipe (66), and an outlet pipe (67). The inlet pipe (66) of the oil separator (75) is connected to the second port of the first four-way switching valve (12) while the outlet pipe (67) thereof is connected to the suction pipe (25) of the compressor (20).

The oil return pipe (77) connects the oil separator (75) and the expander casing (34) to form an oil return path. The oil return pipe (77) is connected at one end thereof to the bottom of the body member (65) of the oil separator (75) while being connected at the other end thereof to the bottom of the expander casing (34). The internal space of the body member (65) of the oil separator (75) communicates with the oil reservoir (37) in the expander casing (34) through the oil return pipe (77).

-Driving Operation-

The driving operations of the air conditioner (10) of the present embodiment in the cooling operation and the heating operation are the same as those of the air conditioner (10) of Embodiment 4. Herein, an oil amount adjusting operation performed in the air conditioner (10) of the present embodiment will be described.

The refrigerator oil discharged from the compressor (20) together with the refrigerant and flowing in the refrigerant circuit (11) flows into the expansion mechanism (31) through the inflow pipe (35) of the expander (30). The refrigerator oil flowing in the expansion mechanism (31) flows out from the expander (30) through the outflow pipe (36) together with the refrigerator oil supplied from the oil reservoir (37) in the expander casing (34) to the expansion mechanism (31). The refrigerator oil flowing out from the expansion mechanism (31) and flowing in the refrigerant circuit (11) together with the refrigerant flows into the oil separator (75).

The refrigerator oil flowing in the body member (65) of the oil separator (75) is separated from the refrigerant and is then reserved in the bottom of the body member (65). The refrigerator oil reserved in the body member (65) is supplied to the oil reservoir (37) in the expander casing (34) through the oil return pipe (77). On the other hand, the refrigerant separated from the refrigerator oil in the oil separator (75) flows into the compressor casing (24) through the suction pipe (25) of the compressor (20). In this way, both the refrigerator oil flowing out from the compressor (20) and the refrigerator oil flowing out from the expander (30) are collected once in the oil reservoir (37) in the expander casing (34) in the present embodiment.

The controller (53) opens the oil amount adjusting valve (53) when it judges that the oil level in the oil reservoir (37) in the expander casing (34) is equal to or higher than a predetermined upper limit level to supply the refrigerator oil in the expander casing (34) to the compressor engine casing (24). The controller (53) closes the oil amount adjusting valve (53) when it judges that the oil level in the oil reservoir (37) in the expander casing (34) lowers up to a predetermined reference level. The operation of the controller (53) on the oil amount adjusting valve (52) in this way results in distribution of the refrigerator oil collected in the oil reservoir (37) in the expander casing (34) to the oil reservoir (27) in the compressor casing (24).

-Effects of Embodiment 6-

In the present embodiment, the refrigerator oil is collected in the oil separator (75) arranged on the suction side of the compressor (20). Accordingly, the amount of the refrigerator oil flowing into the compressor casing (24) together with the refrigerant can be reduced. In other words, the amount of the refrigerator oil sucked into the compression mechanism (21) can be reduced. Since the volume of the fluid that the compression mechanism (21) can suck at one stroke of suction is determined, reduction in the amount of the lubricant oil sucked into the compression mechanism (21) together with the refrigerant results in an increase in the amount of the refrigerant sucked into the compression mechanism (21). Hence, the compressor (20) can exert its performance fully in the present embodiment.

-Modified Example 1 of Embodiment 6-

The equalizing pipe (41) may be omitted from the refrigerant circuit (11) in the air conditioner (10) of the present embodiment.

Figure 14:
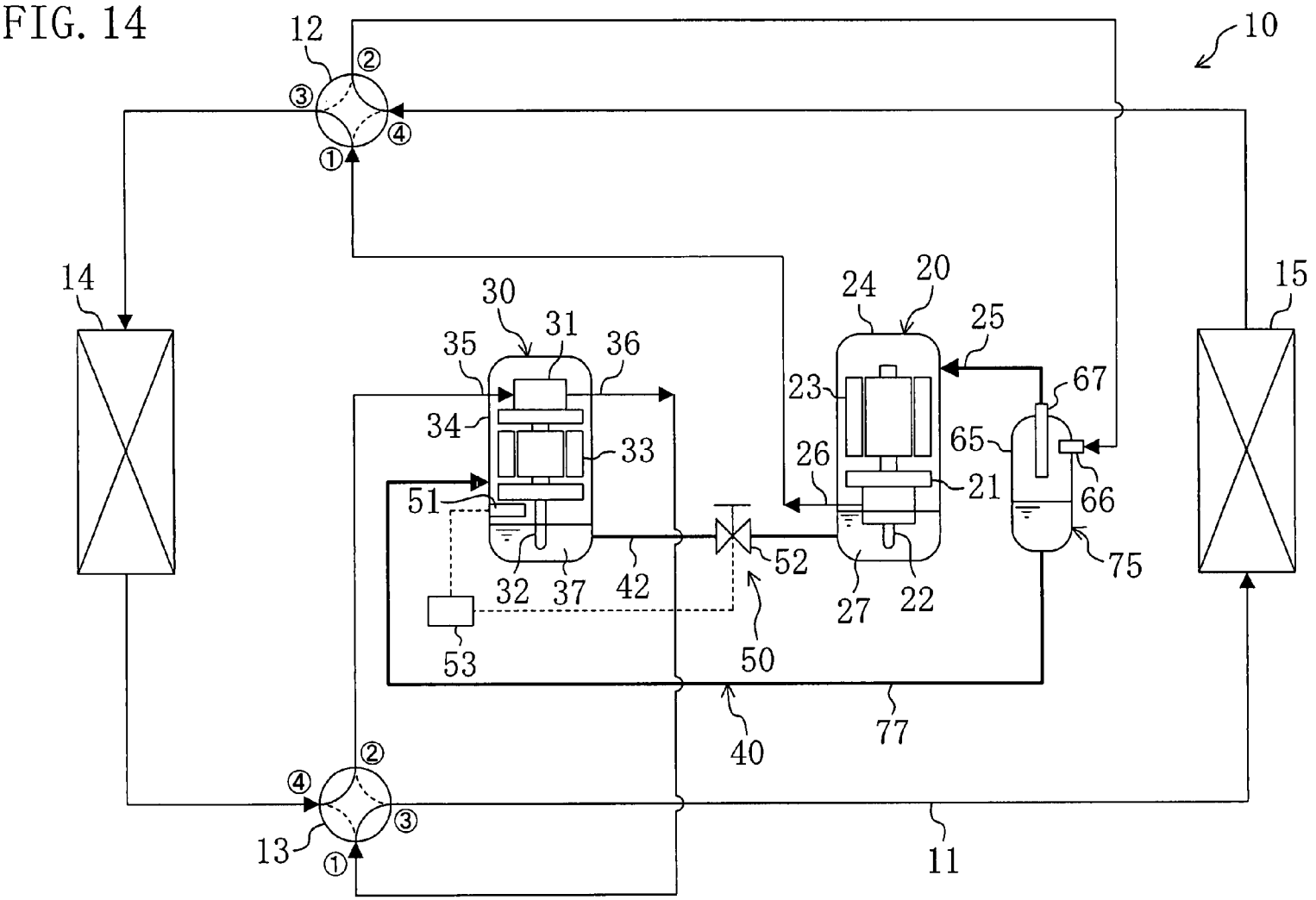
FIG. 14 is a refrigerant circuit diagram showing a construction of a refrigerant circuit in accordance with Modified Example 1 of Embodiment 6.

As shown in FIG. 14, the connection level of the oil return pipe (77) to the expander casing (34) is changed in the present modified example. The terminal end of the oil return pipe (77) is opened to a part always above the oil level in the oil reservoir (37) in the expander casing (34). A part above the oil reservoir (37) in the internal space of the expander casing (34) communicates with the body member (65) of the oil separator (75) through the oil return pipe (77). The body member (65) of the oil separator (75) communicates with a part above the oil reservoir (27) in the internal space of the compressor casing (24) through a pipe connecting the outlet pipe (67) thereof and the suction pipe (25) of the compressor (20).

Thus, in the refrigerant circuit (11) of the present modified example, the internal space of the compressor casing (24) and the internal space of the expander casing (34) communicate with each other through the pipe connecting the outlet pipe (67) of the oil separator (75) and the suction pipe (25) of the compressor (20), the body member (65) of the oil separator (75), an the oil return pipe (77). Namely, the pipe connecting the outlet pipe (67) of the oil separator (75) and the suction pipe (25) of the compressor (20), the body member (65) of the oil separator (75), an the oil return pipe (77) form the equalizing path (40) in the refrigerant circuit (11) of the present modified example.

In the present modified example, the pipe connecting the oil separator (75) and the compressor (20) and the oil return pipe (77) serve as the equalizing path (40) to eliminate the need to provide the equalizing pipe (41) for forming the equalizing path (40), thereby keeping the simple construction of the refrigerant circuit (11).

-Modified Example 2 of Embodiment 6-

The oil separator (75) may be connected to the compressor casing (24) rather than to the expander casing (34) in the refrigerant circuit (11) of the present embodiment.

Figure 15:
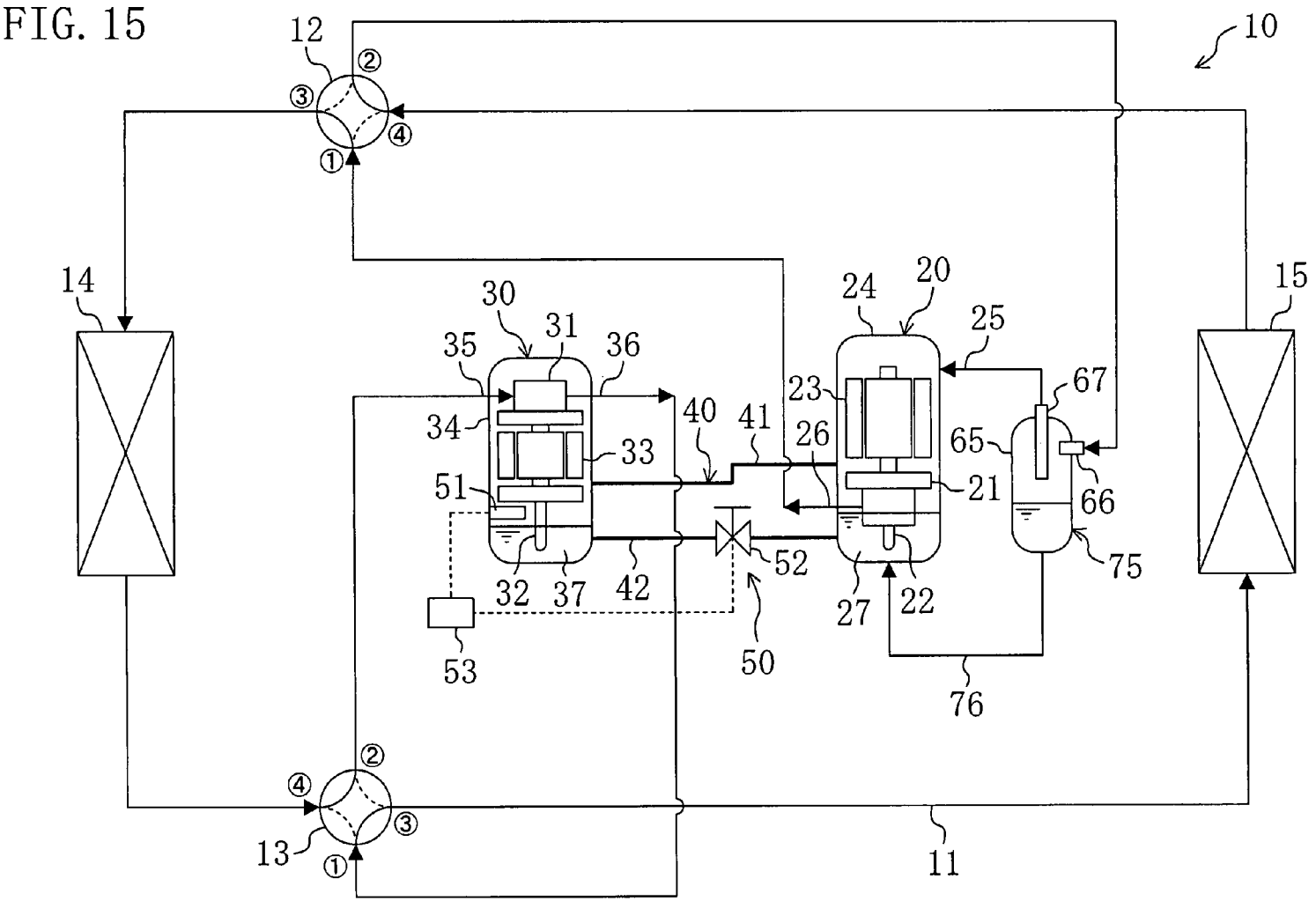
FIG. 15 is a refrigerant circuit diagram showing a construction of a refrigerant circuit in accordance with Modified Example 2 of Embodiment 6.

As shown in FIG. 15, the body member (65) of the oil separator (75) and the compressor casing (24) are connected to each other through an oil return pipe (76) in the refrigerant circuit (11) of the present modified example. The oil return pipe (76) is connected at one end thereof to the bottom of the body member (65) of the oil separator (75) while being connected at the other end thereof to the bottom of the compressor casing (24). The oil return pipe (76) composes an oil return path for allowing the body member (65) of the oil separator (75) and the oil reservoir (27) in the compressor casing (24) to communicate with each other.

In the refrigerant circuit (11) of the present modified example, the refrigerator oil discharged from the compressor (20) together with the refrigerant flows in the refrigerant circuit (11) through the inflow pipe (35) of the expander (30) to the expansion mechanism (31) and flows out then from the expander (30) through the outflow pipe (36) together with the refrigerator oil supplied from the oil reservoir (37) in the expander casing (34) to the expansion mechanism (31). The refrigerator oil flowing out from the expansion mechanism (31) and flowing in the refrigerant circuit (11) together with the refrigerant flows into the oil separator (75), is separated from the refrigerant in the oil separator (75), and is then retuned to the oil reservoir (27) in the compressor casing (24). Namely, both the refrigerator oil flowing out from the compressor (20) and the refrigerator oil flowing out from the expander (30) are collected once in the oil reservoir (27) in the compressor casing (24).

The controller (53) opens the oil amount adjusting valve (52) when it judges that the oil level in the oil reservoir (37) in the expander casing (34) is equal to or lower than a predetermined lower limit level to supply the refrigerator oil in the compressor casing (24) to the expander casing (34). The controller (53) closes the oil amount adjusting valve (52) when it judges that the oil level in the oil reservoir (37) in the expander casing (34) rises up to a predetermined reference level. The operation of the controller (53) on the oil amount adjusting valve (52) in this way results in distribution of the refrigerator oil collected in the oil reservoir (27) in the compressor casing (24) to the oil reservoir (37) in the expander casing (34).

(Embodiment 7 of the Invention)

Embodiment 7 of the present invention will be described. An air conditioner (10) of the present embodiment includes the refrigerant circuit (11) of Embodiment 4 to which an oil separator (70) and an oil return pipe (72) are added. Only the difference of the air conditioner (10) of the present embodiment from that of Embodiment 4 will be described.

Figure 16:
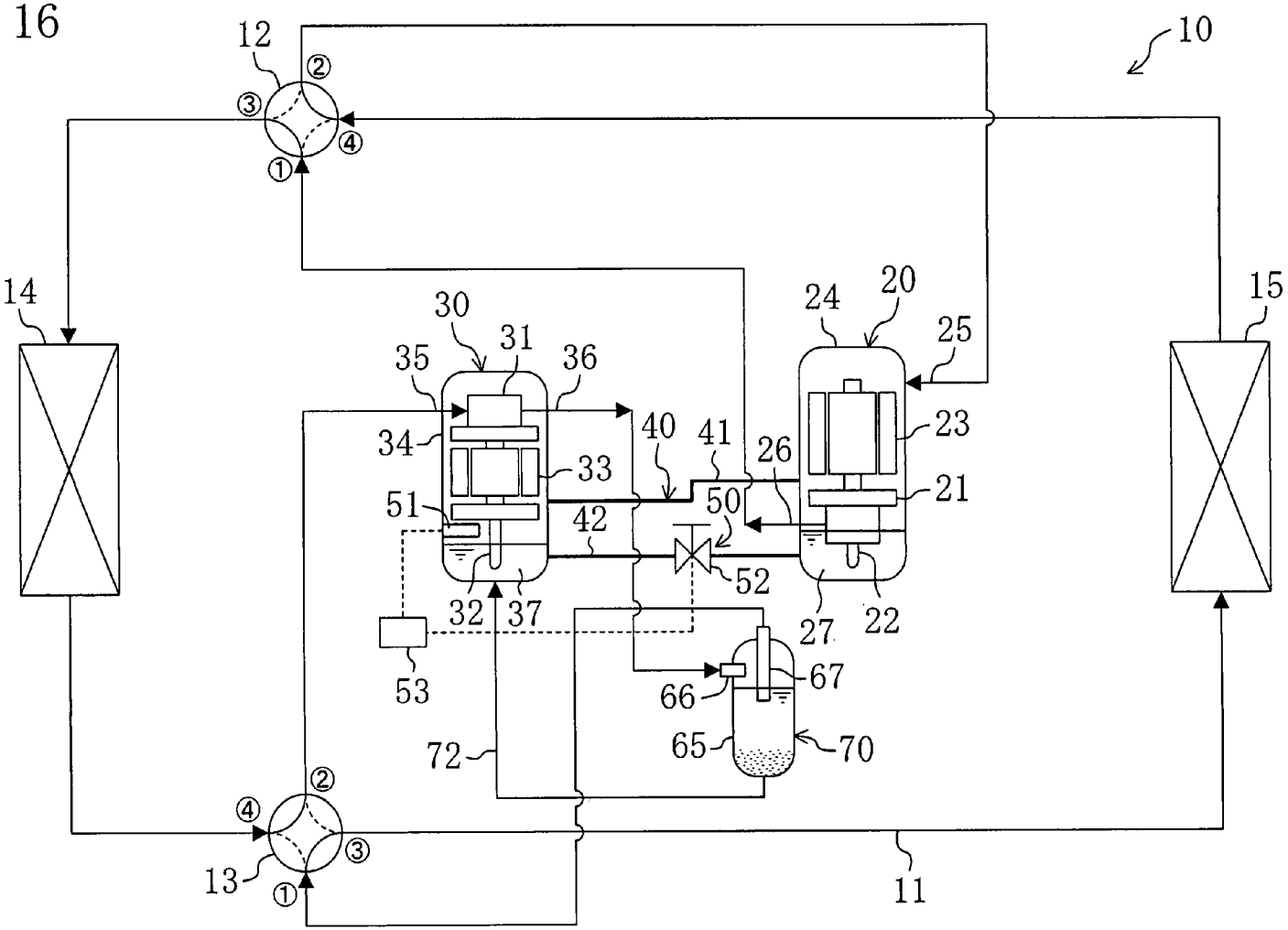
FIG. 16 is a refrigerant circuit diagram showing a construction of a refrigerant circuit in accordance with Embodiment 7.

As shown in FIG. 16, the oil separator (70) is arranged on the outflow side of the expander (30). The oil separator (70) itself has the same construction as the oil separator (60) in Embodiment 2. Specifically, the oil separator (70) includes a body member (65), an inlet pipe (66), and an outlet pipe (67). The inlet pipe (66) of the oil separator (70) is connected to the outflow pipe (36) of the expander (30) while the outlet pipe (67) thereof is connected to the first port of the second four-way switching valve (13).

The oil return pipe (72) connects the oil separator (70) and the expander casing (34). The oil return pipe (72) is connected at one end thereof to the bottom of the body member (65) of the oil separator (70) while being connected at the other end thereof to the bottom of the expander casing (34). The oil return pipe (72) composes an oil return path for allowing the body member (65) of the oil separator (70) and the oil reservoir (37) in the expander casing (34) to communicate with each other.

-Driving Operation-

The driving operations of the air conditioner (10) of the present embodiment in the cooling operation and the heating operation are the same as those of the air conditioner (10) of Embodiment 4. Herein, an oil amount adjusting operation performed in the air conditioner (10) of the present embodiment will be described.

The refrigerator oil discharged from the compressor (20) together with the refrigerant flows in the refrigerant circuit (11) then into the expansion mechanism (31) through the inflow pipe (35) of the expander (30). The refrigerator oil flowing in the expansion mechanism (31) flows out from the expander (30) through the outflow pipe (36) together with the refrigerator oil supplied to the expansion mechanism (31) from the oil reservoir (37) in the expander casing (34). The refrigerator oil flowing out from the expander (30) flows into the body member (65) of the oil separator (70) together with the expanded refrigerant in a gas-liquid two-phase state. Similarly to the case in Embodiment 3, the mixture of the refrigerator oil and the liquid refrigerant is reserved in the bottom of the body member (65), and the refrigerator oil is present excessively in the lower part of the liquid reservoir.

The outlet pipe (67) of the oil separator (70) is dipped at the lower end thereof in the liquid reserved in the body member (65). The liquid refrigerant present in the upper layer in the liquid reservoir flows out from the body member (65) through the outlet pipe (67) and is then supplied to the indoor heat exchanger (15) in the cooling operation while on the other hand being supplied to the outdoor heat exchanger (14) in the heating operation.

The refrigerator oil reserved in the body member (65) of the oil separator (70) is supplied to the oil reservoir (37) of the expander casing (34) through the oil return pipe (72). Namely, in the present embodiment, both the refrigerator oil flowing out from the compressor (20) and the refrigerator oil flowing out from the expander (30) are collected once in the oil reservoir (37) in the expander casing (34).

The controller (53) opens the oil amount adjusting valve (52) when it judges that the oil level in the oil reservoir (37) in the expander casing (34) becomes equal to or higher than a predetermined upper limit level. In this state, the oil level in the oil reservoir (37) in the expander casing (34) is higher than the oil level in the oil reservoir (27) in the compressor casing (24). Accordingly, the refrigerator oil in the expander casing (34) flows into the compressor casing (24) through the oil pipe (42). The controller (53) closes the oil amount adjusting valve (53) when it judges that the oil level in the oil reservoir (37) in the expander casing (34) lowers up to a predetermined reference level. The operation of the controller (53) on the oil amount adjusting valve (52) in this way results in distribution of the refrigerator oil collected in the oil reservoir (37) in the expander casing (34) to the oil reservoir (27) in the compressor casing (24).

-Effects of Embodiment 7-

In the present embodiment, the lubricant oil is collected in the oil separator (70) arranged on the outflow side of the expander (30). Accordingly, the same effects as those in Embodiment 3 can be obtained. Namely, the situation that the lubricant oil inhibits heat exchange between the refrigerant and the air in a heat exchanger functioning as an evaporator can be suppressed to allow the heat exchanger to exert its performance fully.

-Modified Example of Embodiment 7-

The oil separator (70) may be connected to the compressor casing (24) rather than to the expander casing (34) in the refrigerant circuit (11) of the present embodiment.

Figure 17:
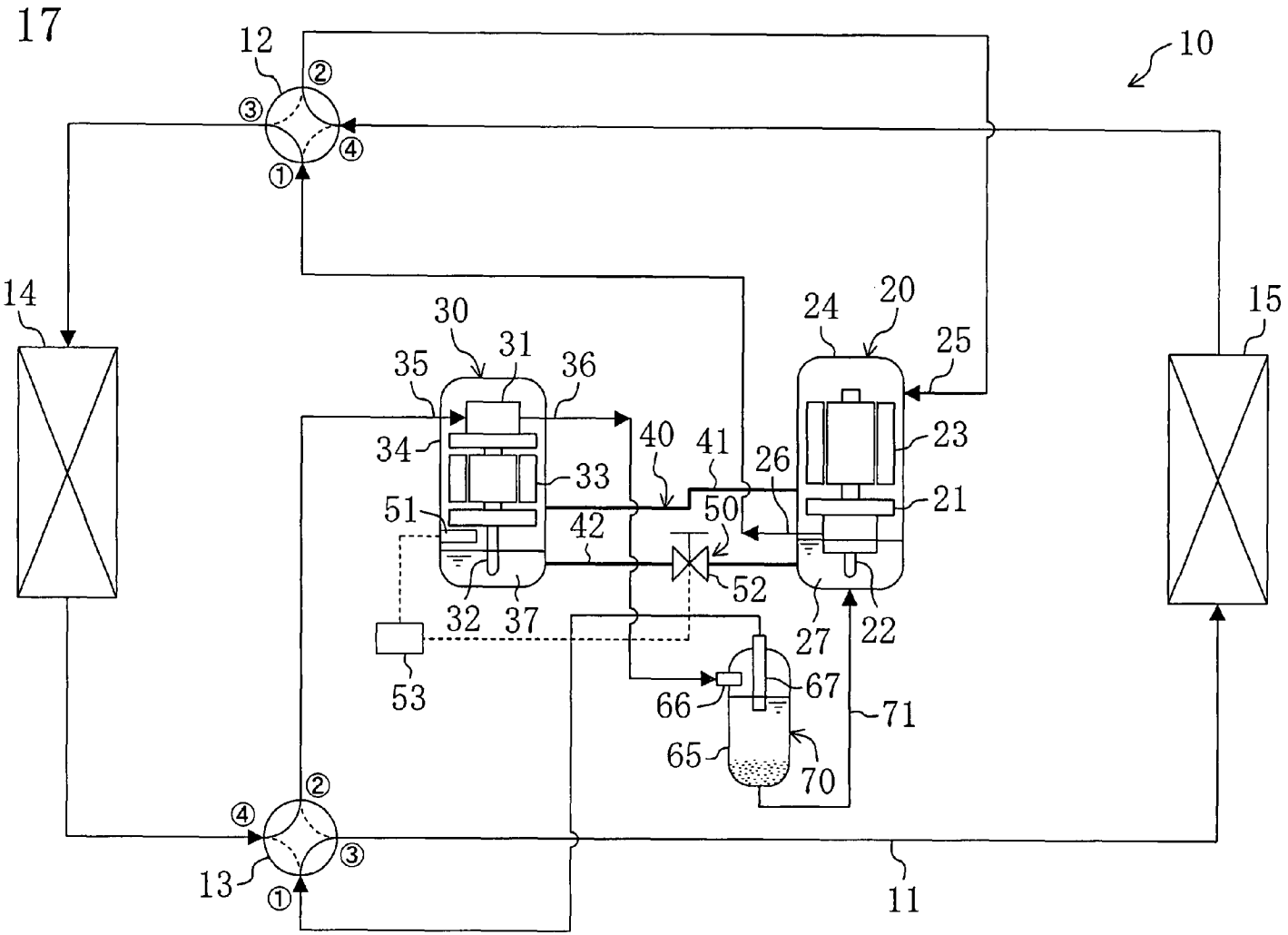
FIG. 17 is a refrigerant circuit diagram showing a construction of a refrigerant circuit in accordance with a modified example of Embodiment 7.

As shown in FIG. 17, the body member (65) of the oil separator (70) and the compressor casing (24) are connected to each other through an oil return pipe (71) in the present modified example. The oil return pipe (71) is connected at one end thereof to the bottom of the body member (65) of the oil separator (70) while being connected at the other end thereof to the bottom of the compressor casing (24). The oil return pipe (71) composes an oil return path for allowing the body member (65) of the oil separator (70) and the oil reservoir (27) in the compressor casing (24) to communicate with each other.

In the refrigerant circuit (11) of the present modified example, the refrigerator oil flowing out from the compressor (20) and the refrigerator oil flowing out from the expander (30) are separated from the refrigerant in the oil separator (70) and are the returned to the oil reservoir (27) in the compressor casing (24) through the oil return pipe (71). Namely, in the present modified example, both the refrigerator oil flowing out from the compressor (20) and the refrigerator oil flowing out from the expander (30) are collected once in the oil reservoir (27) in the compressor casing (24).

The controller (53) opens the oil amount adjusting valve (52) when it judges that the oil level in the oil reservoir (37) in the expander casing (34) is equal to or lower than a predetermined lower limit level to supply the refrigerator oil in the compressor casing (24) to the expander casing (34). The controller (53) closes the oil amount adjusting valve (52) when it judges that the oil level in the oil reservoir (37) in the expander casing (34) rises up to a predetermined reference level. The operation of the controller (53) on the oil amount adjusting valve (52) in this way results in distribution of the refrigerator oil collected in the oil reservoir (27) in the compressor casing (24) to the oil reservoir (37) in the expander casing (34).

<Other Embodiments>

The above embodiments may have any of the following constructions.

-First Modified Example-

Figure 18:
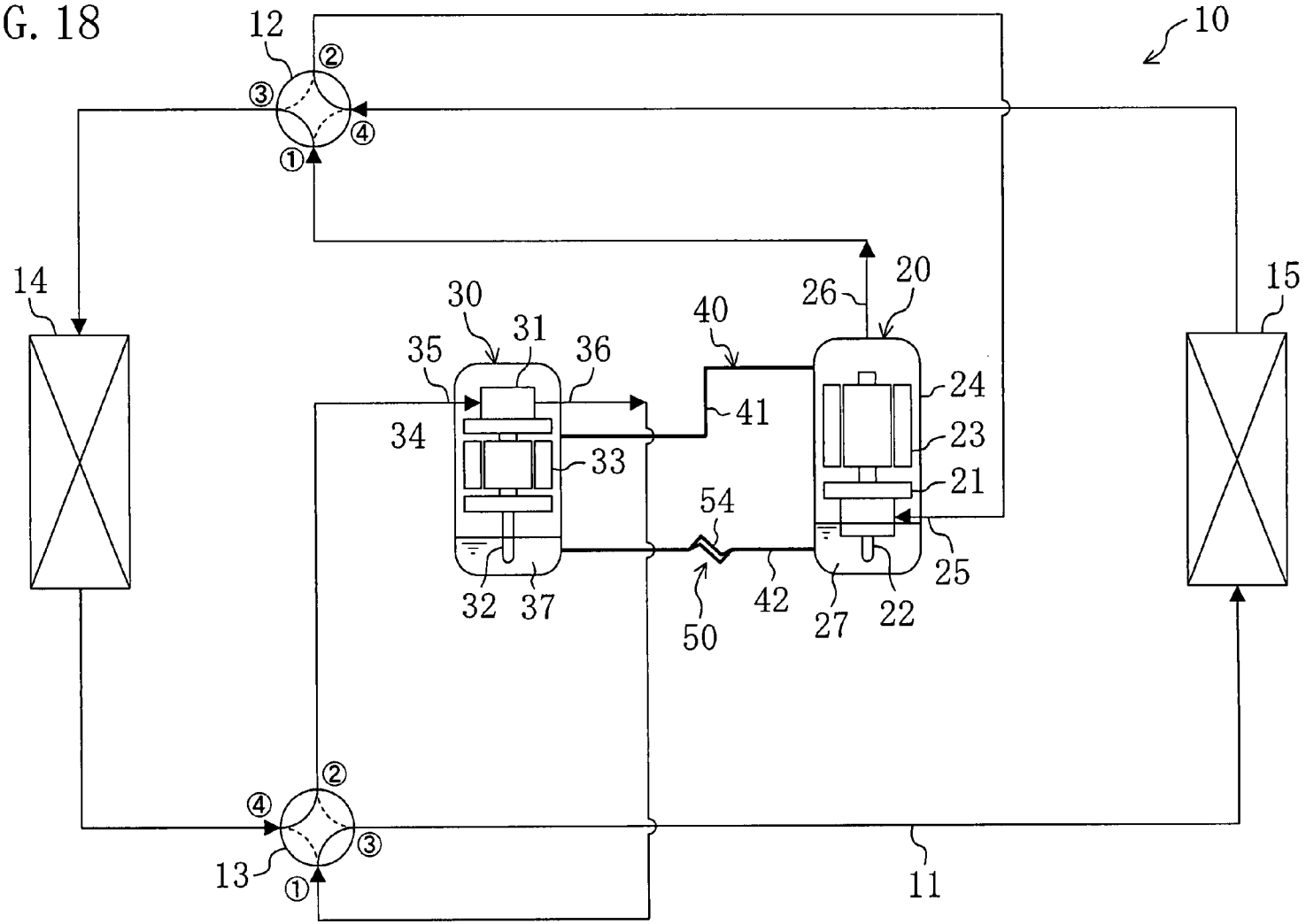
FIG. 18 is a refrigerant circuit diagram showing a construction of a refrigerant circuit in accordance with a first modified example of another embodiment.

In each of the above embodiments, a capillary tube (54) as adjusting means may be provided in the middle of the oil pipe (42), as shown in FIG. 18. The refrigerant circuit (11) shown in FIG. 18 is Embodiment 1 to which the present modified example is applied. Provision of the capillary tube (54) in the oil pipe (42) reduces the flow rate of the refrigerator oil flowing in the oil pipe (42) to some extent. Accordingly, even when the inner pressure of the compressor casing (24) transiently differ from the inner pressure of the expander casing (34), the refrigerator oil is prevented from flowing from one of the compressor (20) and the expander (30) to the other through the oil pipe (42), thereby securing the reserved amount of the refrigerator oil in each of the compressor (20) and the expander (30).

-Second Modified Example-

Figure 19:
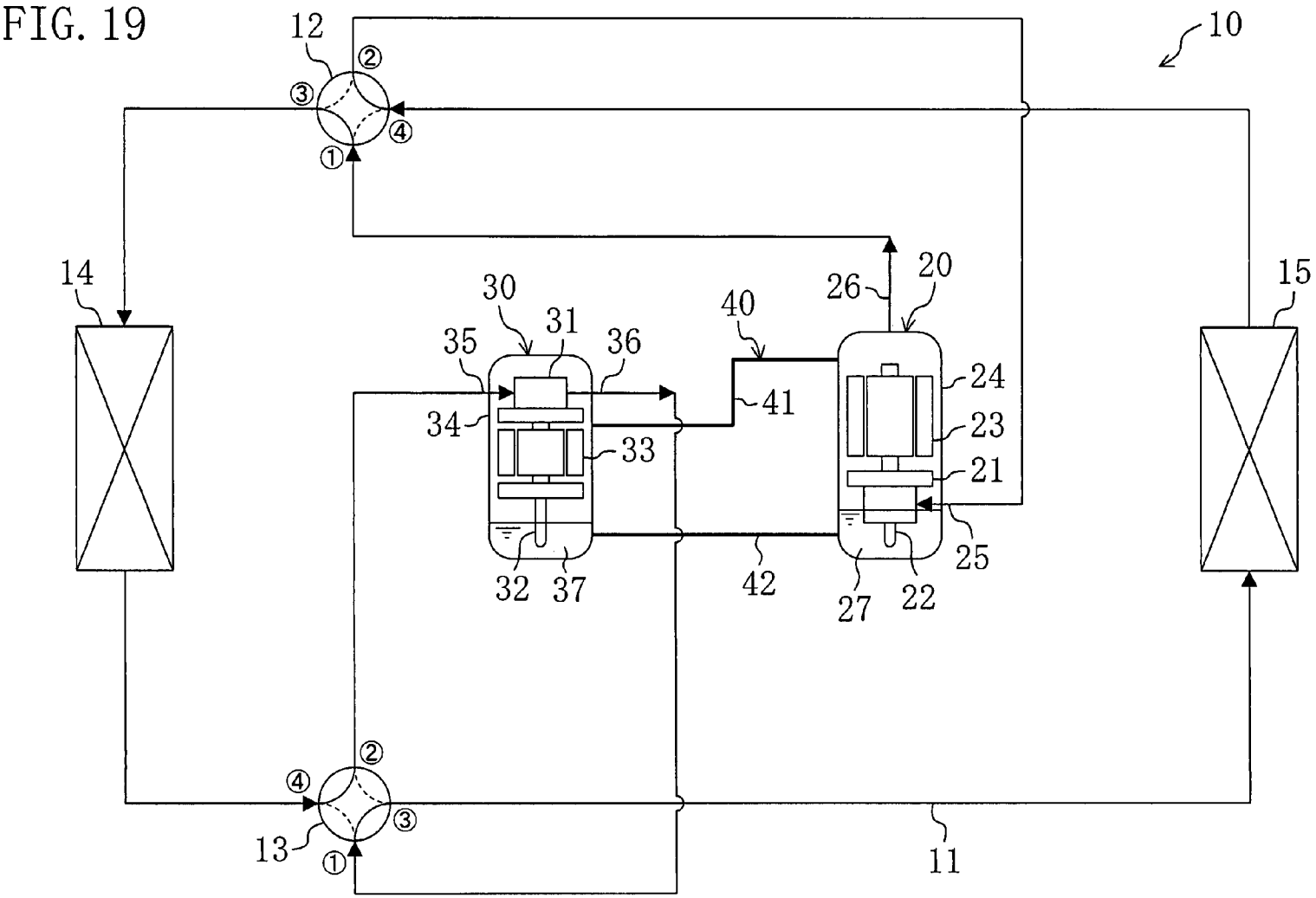
FIG. 19 is a refrigerant circuit diagram showing a construction of a refrigerant circuit in accordance with a second modified example of the other embodiment.

In each of the above embodiments, the adjusting means may be omitted, as shown in FIG. 19. The refrigerant circuit (11) shown in FIG. 19 is Embodiment 1 to which the present modified example is applied.

In the present modified example, the oil reservoir (27) in the compressor casing (24) and the oil reservoir (37) in the expander casing (34) always communicate with each other through the oil pipe (42). In the oil pipe (42), the refrigerator oil flows from one of the oil reservoir (27) in the compressor casing (24) and the oil reservoir (37) in the expander casing (34) whichever the oil level therein is higher to the other in which the oil level is lower. When the oil level in the oil reservoir (27) in the compressor casing (24) and that in the oil reservoir (37) in the expander casing (34) are equal to each other, the refrigerator oil stops flowing in the oil pipe (42).

Thus, the present modified example, the reserved amount of the refrigerator oil can be equalized between the compressor casing (24) and the expander casing (34) without performing any control. Hence, in the present modified example, complication of the refrigerant circuit (11) can be suppressed as far as possible with the reliability of the compressor (20) and the expander (30) ensured.

-Third Modified Example-

Figure 20:
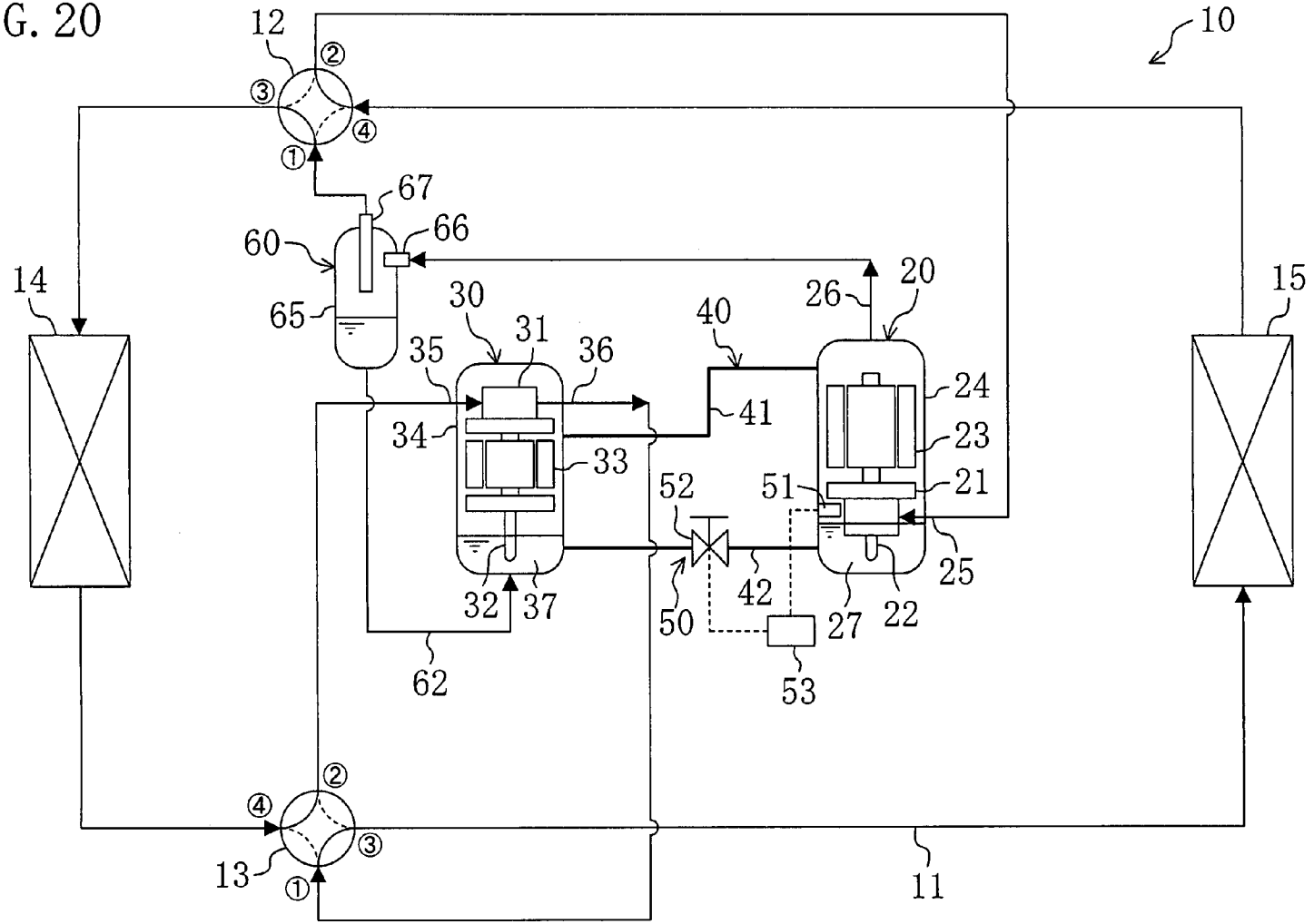
FIG. 20 is a refrigerant circuit diagram showing a construction of a refrigerant circuit in accordance with a third modified example of the other embodiment.

In each of the above embodiments, the oil level sensor (51) may be provided inside the compressor casing (24), as shown in FIG. 20. The refrigerant circuit (11) shown in FIG. 20 is Embodiment 2 to which the present modified example is applied.

The controller (53) in the present modified example opens the oil amount adjusting valve (52) when it judges that the oil level in the oil reservoir (27) in the compressor casing (24) becomes equal to or lower than a predetermined lower limit level. In this state, the oil level in the oil reservoir (27) in the compressor casing (24) is lower than that in the oil reservoir (37) in the expander casing (34). Accordingly, the refrigerator oil in the expander casing (34) flows into the compressor casing (24) through the oil pipe (42). The controller (53) closes the oil amount adjusting valve (52) when it judges that the oil level in the oil reservoir (27) in the compressor casing (24) rises up to a predetermined reference level.

Further, the controller (53) opens the oil amount adjusting valve (52) when it judges that the oil level in the oil reservoir (27) in the compressor casing (24) is equal to or higher than a predetermined level. In this state, the oil level in the oil reservoir (27) in the compressor casing (24) is higher than that in the oil reservoir (37) in the expander casing (34). Accordingly, the refrigerator oil in the compressor casing (24) flows into the expander casing (34) through the oil pipe (42). The controller (53) closes the oil amount adjusting valve (52) when it judges that the oil level in the oil reservoir (27) in the compressor casing (24) lowers up to a predetermined reference level.

-Fourth Modified Example-

Figure 21:
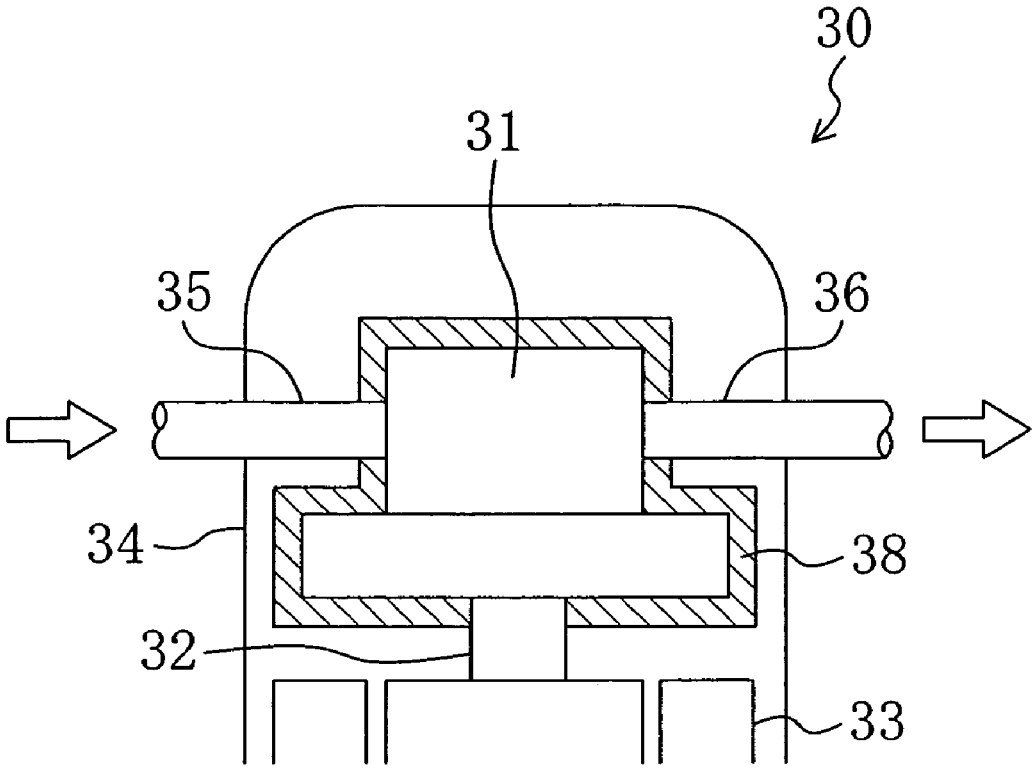
FIG. 21 is an enlarged view of a main part of an expander in a fourth modified example of the other embodiment.

In each of the above embodiments, the expansion mechanism (31) in the expander casing (34) may be surrounded by a thermal insulation material (38), as shown in FIG. 21. As described above, heat invasion from outside to the refrigerant passing through the expansion mechanism (31) reduces, by the amount of the invading heat, the absorption amount of the heat of the refrigerant in a heat exchanger functioning as an evaporator. In contrast, when the expansion mechanism (31) is surrounded by the thermal insulation material (38) as in the present modified example, the amount of heat invading the refrigerant passing through the expansion mechanism (31) can be reduced to allow the heat exchanger functioning as an evaporator to exert its performance fully.

Herein, in the case where the compressor (20) is of high pressure dome type as in Embodiments 1 to 3, the atmospheric temperature in the expander casing (34) becomes high when compared with the case where the compressor (20) is of low pressure dome type as in Embodiments 4 to 7. Accordingly, the present modified example is especially effective in the case where the compressor (20) is of high pressure dome type as in Embodiments 1 to 3.

-Fifth Modified Example-

Although each of the compression mechanism (21) and the expansion mechanism (31) is composed of a rotary fluid machinery in each of the above embodiments, the fluid machineries of the compression mechanism (21) and the expansion mechanism (31) are not limited thereto. For example, each of the compression mechanism (21) and the expansion mechanism (31) may be composed of a scroll fluid machinery. Alternatively, the compression mechanism (21) and the expansion mechanism (31) may be composed of fluid machineries of different types.

-Sixth Modified Example-

The oil supply paths formed in the drive shaft (22) of the compressor (20) and the output shaft (32) of the expander (30) compose the centrifugal pumps in each of the above embodiments, but a mechanical pump (a gear pump, a trochoid pump, or the like, for example) may be connected to the lower end of the drive shaft (11) or the output shaft (32) to drive the mechanical pump by the drive shaft (22) or the output shaft (32) for oil supply to the compression mechanism (21) or the expansion mechanism (31).

In the case where the compressor (20) is of low pressure dome type as in Embodiments 4 to 7, the inner pressure of the compressor casing (24) and the inner pressure of the expander casing (34) are almost equal to the low pressure of the refrigeration cycle to invite difficulty in securing a sufficient amount of oil supply by the centrifugal pumps. Accordingly, it is preferable in this case to provide a mechanical type oil supply pump to the compressor (20) or the expander (30).

The above embodiments are mere essentially preferable examples and are not intended to limit the present invention and applicable objects and use thereof.

INDUSTRIAL APPLICABILITY

As described above, the present invention is useful in refrigerating apparatuses including a refrigerant circuit in which a compressor and an expander are housed in separate casings.

The invention claimed is:

1. A refrigerating apparatus including a refrigerant circuit to which a compressor and an expander are connected and performing a refrigeration cycle by circulating refrigerant in the refrigerant circuit, comprising:

in the compressor, a compression mechanism for sucking and compressing the refrigerant; a compressor casing for housing the compression mechanism; and an oil supply mechanism for supplying lubricant oil from an oil reservoir in the compressor casing to the compression mechanism;

in the expander, an expansion mechanism for expanding the refrigerant flowing therein to generate motive power; an expander casing for housing the expansion mechanism; and an oil supply mechanism for supplying the lubricant oil from an oil reservoir in the expander to the expansion mechanism;

an equalizing path which connects the compressor casing and the expander casing for equalizing pressures of an internal space of the compressor casing and an internal space of the expander casing to each other;

an oil distribution path which connects the compressor casing and the expander casing for allowing the lubricant oil to flow between the oil reservoir in the compressor casing and the oil reservoir in the expander casing;

an oil level detector which is provided only in the expander casing and detects a position of an oil level; and a control valve which is provided in the oil distribution path, and of which opening is controlled on the basis of an output signal of the oil level detector.

2. The refrigerating apparatus of claim 1, wherein the refrigerant circuit includes an oil separator arranged on a discharge side of the compressor for separating the lubricant oil from the refrigerant and an oil return path for supplying the lubricant oil from the oil separator to the compressor casing.

3. The refrigerating apparatus of claim 1, wherein the refrigerant circuit includes an oil separator arranged on a discharge side of the compressor for separating the lubricant oil from the refrigerant and an oil return path for supplying the lubricant oil from the oil separator to the expander casing.

4. The refrigerating apparatus of claim 1, wherein the refrigerant circuit includes an oil separator arranged on an outflow side of the expander for separating the lubricant oil from the refrigerant and an oil return path for supplying the lubricant oil from the oil separator to the compressor casing.

5. The refrigerating apparatus of claim 1, wherein the compression mechanism compresses the refrigerant directly sucked from outside of the compressor casing and discharges the refrigerant into the compressor casing.

6. The refrigerating apparatus of claim 5, wherein the refrigerant circuit includes an oil separator arranged on a discharge side of the compressor for separating the lubricant oil from the refrigerant and an oil return path for supplying the lubricant oil from the oil separator to the expander casing, and a pipe connecting the compressor and the oil separator and the oil return path serve as the equalizing path.

7. The refrigerating apparatus of claim 1, wherein the compression mechanism compresses the refrigerant sucked from the compressor casing and discharges it outside the compressor casing directly.

8. The refrigerating apparatus of claim 7, wherein the refrigerant circuit includes an oil separator arranged on a suction side of the compressor for separating the lubricant oil from the refrigerant and an oil return path for supplying the lubricant oil from the oil separator to the compressor casing.

9. The refrigerating apparatus of claim 7, wherein the refrigerant circuit includes an oil separator arranged on a suction side of the compressor for separating the lubricant oil from the refrigerant and an oil return path for supplying the lubricant oil from the oil separator to the expander casing.

10. The refrigerating apparatus of claim 9, wherein a pipe connecting the oil separator and the compressor and the oil return path serve as the equalizing path.

11. The refrigerating apparatus of claim 7, wherein the refrigerant circuit includes an oil separator arranged on an outflow side of the expander for separating the lubricant oil from the refrigerant and an oil return path for supplying the lubricant oil from the oil separator to the expander casing.

12. The refrigerating apparatus of claim 1, wherein the equalizing path includes an equalizing pipe that is opened at one end to an internal space above the compression mechanism in the compressor casing.

13. The refrigerating apparatus of claim 12, wherein the compressor further includes a motor, and the equalizing pipe is opened at one end to an internal space above the motor in the compressor casing.

14. The refrigerating apparatus of claim 12, wherein the expander further includes a generator, and the equalizing pipe is opened at another end to an internal space between the expansion mechanism and the generator in the expander casing.

15. The refrigerating apparatus of claim 1, wherein only lubricant oil flowing from the oil reservoir in the compressor casing into the oil distribution path is supplied to the oil reservoir in the expander casing.

* * * * *